US008532544B2

(12) United States Patent
Kakuta et al.

(10) Patent No.: US 8,532,544 B2
(45) Date of Patent: Sep. 10, 2013

(54) DEVELOPER CONTAINER, DEVELOPING APPARATUS AND PROCESS CARTRIDGE

(75) Inventors: Hideki Kakuta, Suntou-gun (JP); Tatsuya Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/419,869

(22) Filed: Mar. 14, 2012

(65) Prior Publication Data

US 2012/0170955 A1 Jul. 5, 2012

Related U.S. Application Data

(62) Division of application No. 12/961,626, filed on Dec. 7, 2010, now Pat. No. 8,185,023, which is a division of application No. 11/933,551, filed on Nov. 1, 2007, now Pat. No. 7,860,437.

(30) Foreign Application Priority Data

Dec. 11, 2006 (JP) ..... 2006-333897
Oct. 25, 2007 (JP) ..... 2007-278173

(51) Int. Cl.
*G03G 15/08* (2006.01)

(52) U.S. Cl.
USPC ..... 399/262; 399/25; 399/111; 399/120; 399/258; 222/DIG. 1

(58) Field of Classification Search
USPC ..... 399/25, 98, 111, 119, 120, 253, 254, 399/262, 272; 222/DIG. 1
See application file for complete search history.

(56) References Cited

U.S. PATENT DOCUMENTS 5,419,468 A 5/1995 Taki
5,548,386 A 8/1996 Fukuda
5,797,075 A 8/1998 Saito et al.
5,884,130 A * 3/1999 Tsutsumi et al. ..... 399/254

(Continued)

FOREIGN PATENT DOCUMENTS

JP 4-21879 A 1/1992
JP 5-313491 A 11/1993

(Continued)

OTHER PUBLICATIONS

Notification of Reasons for Refusal dated Feb. 28, 2012, in Japanese Application No. 2011-177343.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

A developer container for an image forming apparatus includes a developer accommodating chamber, provided with an opening, for accommodating a developer to be supplied to the opening; a feeding member, provided in the developer accommodating chamber and having an elasticity, for feeding the developer by rotation thereof; a deforming portion, provided in the developer accommodating chamber and contactable to the feeding member, for deforming the feeding member against the elasticity with the rotation of the feeding member; and a restoration portion for permitting the feeding member deformed by the deformed portion to restore elastically, thereby to throw the developer toward the opening, wherein a boundary portion between the deformed portion the restoration portion is disposed below a lower end of the opening.

29 Claims, 13 Drawing Sheets

(56) References Cited

U.S. PATENT DOCUMENTS

| | | | | |
|---|---|---|---|---|
| 5,995,791 | A * | 11/1999 | Kawasaki | 399/281 |
| 6,804,476 | B2 * | 10/2004 | Yokoi et al. | 399/27 |
| 6,856,155 | B2 * | 2/2005 | Tay et al. | 324/750.05 |
| 6,907,215 | B2 | 6/2005 | Yasukawa et al. | |
| 7,058,342 | B2 | 6/2006 | Jeon | |
| 7,107,002 | B2 * | 9/2006 | Saito et al. | 399/360 |
| 7,184,693 | B2 | 2/2007 | Choi et al. | |
| 7,231,164 | B2 * | 6/2007 | Harada et al. | 399/106 |
| 7,558,514 | B2 * | 7/2009 | Yamamura | 399/256 |
| 7,627,272 | B2 | 12/2009 | Iwamura | |
| 2005/0002698 | A1 | 1/2005 | Jeon | |
| 2005/0208404 | A1 * | 9/2005 | Miyakawa et al. | 430/108.1 |
| 2006/0198643 | A1 | 9/2006 | Kimura et al. | |
| 2006/0222414 | A1 * | 10/2006 | Yamamura | 399/263 |
| 2008/0095553 | A1 | 4/2008 | Tanaka et al. | |
| 2008/0292331 | A1 | 11/2008 | Yokomori et al. | |

FOREIGN PATENT DOCUMENTS

| | | | | |
|---|---|---|---|---|
| JP | 8-36302 | A | | 2/1996 |
| JP | 8-44206 | A | | 2/1996 |
| JP | 08044206 | A | * | 2/1996 |
| JP | 9-244406 | A | | 9/1997 |
| JP | 10-10854 | A | | 1/1998 |
| JP | 2001-194877 | A | | 7/2001 |
| JP | 2002014531 | A | * | 1/2002 |
| JP | 2003-173083 | A | | 6/2003 |
| JP | 2004-219718 | A | | 8/2004 |
| JP | 2004-286849 | A | | 10/2004 |
| JP | 2006-276615 | A | | 10/2006 |
| KR | 10-1994-0025786 | A | | 12/1994 |
| KR | 10-2005-0004506 | A | | 1/2005 |
| KR | 10-2005-0037727 | A | | 4/2005 |
| KR | 10-2007-0072589 | A | | 7/2007 |

OTHER PUBLICATIONS

Notice of Allowance dated May 29, 2009, in counterpart Korean Application No. 10-2007-0127921.

Notification of Reasons for Refusal dated Jun. 14, 2011, in counterpart Japanese Application No. 2007-278173.

* cited by examiner

DEVELOPER CONTAINER, DEVELOPING APPARATUS AND PROCESS CARTRIDGE

CROSS-REFERENCE TO RELATED APPLICATIONS

This application is a divisional of U.S. patent application Ser. No. 12/961,626, filed Dec. 7, 2010, which is a divisional of U.S. patent application Ser. No. 11/933,551, filed Nov. 1, 2007, which issued as U.S. Pat. No. 7,860,437, on Dec. 28, 2010.

FIELD OF THE INVENTION AND RELATED ART

The present invention relates to a developer container, a developing apparatus, and a process cartridge removably mountable in an electrophotographic image forming apparatus.

Here, an "electrophotographic image forming apparatus (which hereafter may be referred to simply as "image forming apparatus")" means an apparatus which forms an image on a recording medium (sheet of recording medium) with the use of an electrophotographic image forming system. An "electrophotographic image forming apparatus" includes, for example, a copying machine, a printer (laser beam printer, LED printer, etc.), a facsimile machine, a word processor, and a multifunction machine capable of performing two or more functions of the preceding image forming apparatus, etc.

An image forming apparatus, such as a printer, which uses an electrophotographic image forming system (electrophotographic process), records an image by carrying out the following steps: First, its electrophotographic photosensitive member (which hereafter will be referred to as "photosensitive member"), which is an image bearing member, is uniformly charged. Then, an electrostatic latent image is formed on the peripheral surface of the photosensitive member by selectively exposing numerous points of the uniformly charged peripheral surface of the photosensitive member. Then, the electrostatic latent image formed on the peripheral surface of the photosensitive member is developed with the toner as a developer, into a visible image, that is, an image formed of toner (which hereafter will be referred to simply as a toner image). Then, the toner image fanned on the peripheral surface of the photosensitive member is transferred onto a sheet of recording medium, such as recording paper, plastic sheet, etc. After the transfer of the toner image onto the sheet of recording medium, the toner image on the sheet of recording medium is fixed to the recording medium by applying heat and pressure to the toner image.

An image forming apparatus, such as the one described above, generally requires to be replenished with developer, and also, requires maintenance for its various processing means. Thus, various ideas have been proposed for making easier the operation for replenishing an image forming apparatus developer, and also, for making it easier to maintain the various processing means. One idea is to integrally dispose a photosensitive member, a charging means, a developing means, a cleaning means, etc., in a cartridge which is removably mountable in the main assembly of an image forming apparatus. This idea has been put to practical use as a process cartridge, which is removably mountable in the main assembly of an image forming apparatus. The employment of an image formation system which uses a process cartridge makes it possible to provide an image forming apparatus superior in usability to an image forming apparatus which does not employ the image forming system based on a process cartridge.

In recent years, a color image forming apparatus which forms a color image by using multiple developers different in color has come to be commonly used. One of the well-known color image forming apparatuses is an image forming apparatus of the so-called in-line type, that is, an image forming apparatus which employs multiple photosensitive members, the number of which corresponds to the number of monochromatic image forming operations carried out, per multicolor image, using multiple developers different in color, and in which the multiple photosensitive members are arranged side by side (juxtaposed) in a single row which is parallel to the direction in which the surface of the member of apparatus, onto which toner images are transferred, is moved. In some of the color image forming apparatuses of the in-line type, the multiple photosensitive members are juxtaposed in a straight row which intersections (is perpendicular to) the vertical direction (direction of gravity); for example, they are juxtaposed in a straight row parallel to the horizontal direction. The in-line configuration is preferable in that the employment of the in-line configuration makes it easier to deal with the demand for the increase in the image formation speed, demand for a multifunction printer, etc., or the like.

Among the image forming apparatuses of the in-line type, in which the multiple photosensitive members are arranged side by side (juxtaposed) in a straight row intersectioning the vertical direction, there are image forming apparatuses in which the multiple photosensitive members are disposed under an intermediary transfer member, that is, a member onto which toner images are temporarily transferred, or under the recording medium bearing member for conveying a sheet of recording medium, which is a final medium onto which toner images are transferred (U.S. Pat. No. 6,907,215).

In the case of the image forming apparatuses in which the photosensitive members are disposed under the intermediary transfer member or recording medium bearing member, the fixing apparatus and developing apparatus, for example, can be positioned so that the intermediary transfer member or recording medium member is between the fixing apparatus and developing apparatus. Therefore, the image forming apparatuses in which the photosensitive members are under the intermediary transfer member or recording medium bearing member enjoy the benefit that the developing apparatus (or exposing apparatus) is unlikely to be affected by the heat from the fixing apparatus.

In the case of some image forming apparatuses in which the photosensitive members are under the intermediary transfer member or recording medium bearing member as described above, it is necessary for developer to be supplied to the developing apparatus against gravity.

That is, generally, a developing apparatus has a development chamber and a developer storage chamber. The development chamber is a chamber in which a member (developer bearing member) for supplying a photosensitive member with developer, a member (developer supplying member) for supplying a developer bearing member with developer, etc., are located. The developer storage chamber is a chamber in which the developer to be conveyed to the development chamber is stored. As described above, in the case of some image forming apparatuses in which the photosensitive members are under the intermediary transfer member or recording medium bearing member, it is necessary for developer to be supplied to the development chamber from the developer storage chamber located at a lower level than the development chamber, that is, developer must be supplied against gravity.

U.S. Pat. No. 6,507,215 discloses one of the means for conveying developer from the developer storage chamber to the development chamber located at a higher level than the developer storage chamber. According to this patent, a member (stirring member) for stirring the developer in the developer storage chamber is provided with a conveying member, which is pasted to the edge of the stirring member. The conveying member is formed of a flexible sheet. In the case of the means recorded in U.S. Pat. No. 6,507,215, however, the developing apparatus is structured so that developer is conveyed into the developer storage chamber by the conveying member attached to the outward edge of the stirring member, in terms of the radius direction of the stirring member, while remaining held by the conveying member. Therefore, the developing apparatus disclosed in the above-mentioned patent is difficult to be reduced in the size of its developer storage chamber. Further, its toner receiving (catching) member is below the supply roller 31. Therefore, it is necessary to ensure that developer will not become packed in the gap between the toner receiving (catching) member and supply roller 31.

SUMMARY OF THE INVENTION

Thus, the primary object of the present invention is to provide a developer container, a developing apparatus, and a process cartridge, which are significantly simpler in structure and smaller than those in accordance with the prior art, and are capable of satisfactorily conveying developer therein against gravity, while being structured so that developer needs to be conveyed against gravity.

Another object of the present invention is to provide a developing apparatus, and a process cartridge, which have a stirring portion capable of stirring developer, between the developer supplying roller and the partition wall located below the developer supplying roller, and which supply the stirred developer to the developer supplying roller.

According to an aspect of the present invention, there is provided a developer container for an image forming apparatus comprising a developer accommodating chamber, provided with an opening for accommodating a developer to be supplied to said opening; a feeding member, provided in said developer accommodating chamber and having an elasticity, for feeding the developer by rotation thereof; a deforming portion, provided in said developer accommodating chamber and contactable to said feeding member, for deforming said feeding member against the elasticity with the rotation of said feeding member; and a restoration portion for permitting said feeding member deformed by said deformed portion to restore elastically, thereby catapulting the developer towards said opening, wherein a boundary portion between said deformed portion and said restoration portion is disposed below a lower end of said opening; and a developing device including the container and a process cartridge including such a developing device.

According to another aspect of the present invention, there is provided a developing device for use with an image forming apparatus, comprising a rotatable developing roller for carrying a developer; a rotatable developer supplying roller for supplying the developer to said developing roller; a partition provided at a position lower than said developer supplying roller; a stirring portion, having an opening for the developer and provided between said developer supplying roller and said partition, for stirring the developer by a swinging motion including a movement of bringing the opening closer to said developer supplying roller and a movement of moving the opening away from said developer supplying roller; and a process cartridge including the developing device.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the developing containers, developing apparatuses, and process cartridges, which are in accordance with the present invention, will be described with reference to the appended drawings.

Embodiment 1

[Electrophotographic Image Forming Apparatus]

Figure 1:
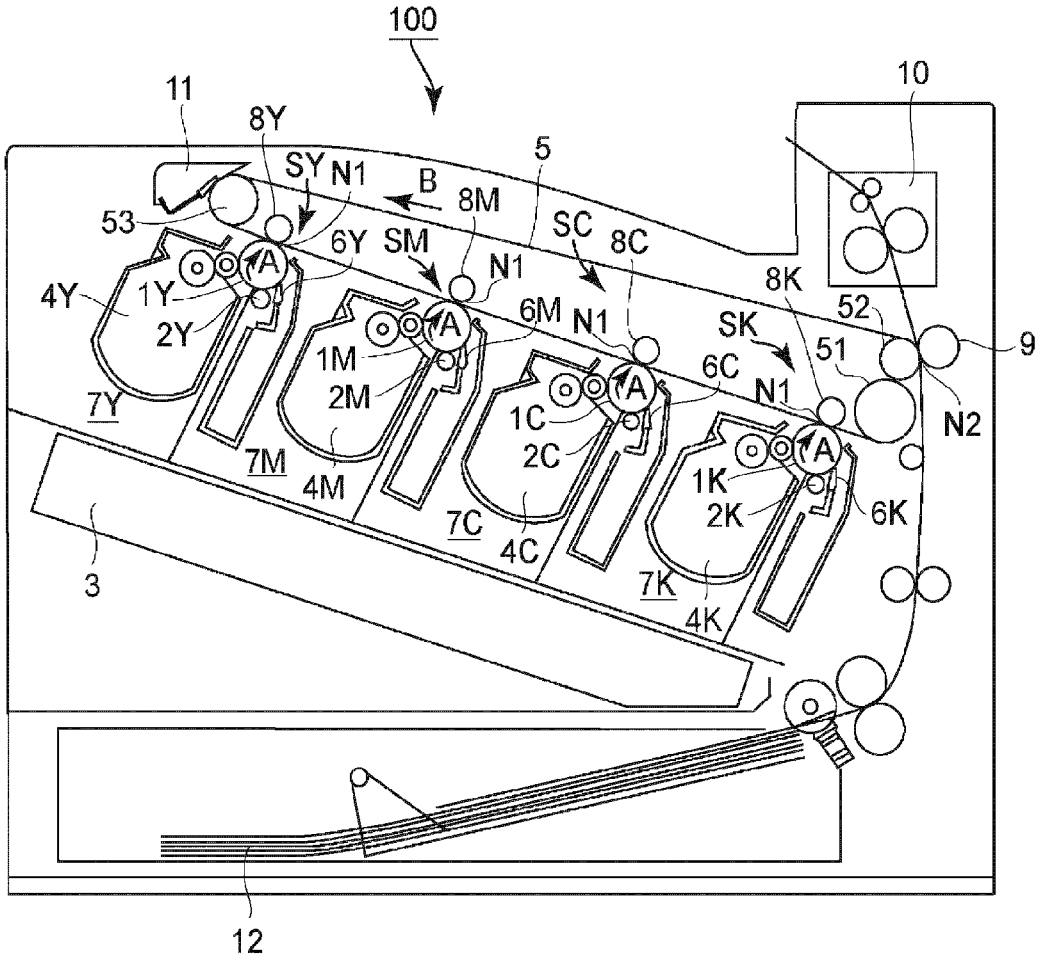
FIG. 1 is a sectional view of the image forming apparatus in the first of the preferred embodiments of the present invention.

First, the electrophotographic image forming apparatus (image forming apparatus) in the first preferred embodiment of the present invention will be described regarding its general structure. FIG. 1 is a schematic sectional view of the image forming apparatus 100 in this embodiment. The image forming apparatus 100 in this embodiment is a full-color laser beam printer of the in-line type, and also, is of the intermediary transfer type. The image forming apparatus 100 is capable of forming a full-color image on a sheet of recording medium (recording paper, plastic sheet, fabric, or the like) according to pictorial information. Pictorial information is inputted into the main assembly of the image forming apparatus from a host device, such as an image reading apparatus connected to the main assembly, a personal computer connected to the main assembly so that information can be exchanged between the main assembly and computer, or the like apparatuses.

The image forming apparatus 100 has multiple image forming portions, more specifically, first, second, third, and fourth image forming portions SY, SM, SC, and SK for forming yellow (Y), magenta (M), cyan (C), and black (K) images, respectively. In this embodiment, the first through fourth image forming portions SY, SM, SC, and SK are arranged side by side (juxtaposed) in a straight row intersectioning the vertical direction.

Incidentally, in this embodiment, the first through fourth image forming portions are virtually the same in structure and operation, although they are different in the color of the image they form. Therefore, unless they need to be differentiated, they will be described together without referring to the alphabetic referential symbols Y, M, C, and K which represent the colors of toner.

The image forming apparatus 100 in this embodiment has multiple image bearing members, more specifically, four electrophotographic photosensitive members 1 which are in the form of a drum (photosensitive drums 1). The multiple image bearing members are arranged side by side (juxtaposed) in parallel in a straight row intersectioning the vertical direction. The photosensitive drum 1 is rotationally driven in the direction (clockwise direction) indicated by an arrow mark A in the drawing, by an unshown driving means (driving force source). The image forming apparatus 100 is also provided with a charge roller 2 and a scanner unit 3 (exposing apparatus), which are in the adjacencies of the peripheral surface of the photosensitive drum 1. The charge roller 2 is a charging means for uniformly charging the peripheral surface of the photosensitive drum 1. The scanner unit 3 (exposing apparatus) is an exposing means for forming an electrostatic image (electrostatic latent image) on the peripheral surface of the photosensitive drum 1, by projecting a beam of laser light, while modulating the beam with pictorial information. Also disposed in the adjacencies of the peripheral surface of the photosensitive drum 1 are a development unit 4 (developing apparatus) and a cleaning member 6. The development unit 4 is a developing means for developing an electrostatic image into a visible image, that is, an image formed of toner. The cleaning member 6 is a cleaning means for removing the toner (transfer residual toner) remaining on the peripheral surface of the photosensitive drum 1 after the toner image transfer. The image forming apparatus 100 is also provided with an intermediary transfer belt 5, which is an intermediary member onto which the toner image on the photosensitive drum 1 is temporarily transferred. The intermediary transfer belt 5 is disposed so that it opposes the four photosensitive drums 1. In terms of the rotational direction of the photosensitive drum 1, the area in which the photosensitive drum 1 is charged by the charge roller 2, the area in which the photosensitive drum 1 is exposed by the scanner unit 3, the area in which the electrostatic image is developed by the development unit 4, the area in which the toner image is transferred from the intermediary transfer belt 5, and the area in which the photosensitive drum 1 is cleaned by the cleaning member 6, are located in the listed order.

Incidentally, in this embodiment, the developer which the development unit 4 uses is nonmagnetic single component developer (toner). The development unit 4 develops an electrostatic image in reverse by placing the development roller (developer bearing member, which will be described later) in contact with the photosensitive drum 1. That is, the development unit 4 in this embodiment adheres the toner, which is the same in polarity as the polarity (negative in this embodiment) to which the photosensitive drum 1 is charged, to the numerous points of the peripheral surface of the photosensitive drum 1, which have reduced in the amount of electric charge by being exposed. As a result, the electrostatic image on the photosensitive drum 1 becomes and is developed.

Also in this embodiment, the photosensitive drum 1, charge roller 2 as a processing means for processing the photosensitive drum 1, developing apparatus 4, and cleaning member 6, are integrated in the form of a cartridge (process cartridge 7), which is removably mountable in the main assembly of the image forming apparatus 100 while being assisted by cartridge mounting means, such as cartridge mounting guides, cartridge positioning members, etc., with which the main assembly is provided. In this embodiment, the four process cartridges 7, which the image forming apparatus requires for the image formation of a multicolor image and which are different in the color of the toner they contain, are the same in shape. The four process cartridges 7 contain yellow (Y), magenta (M), cyan (C), and black (K) toners, respectively. Although this embodiment is described with reference to a process cartridge, the present invention is also compatible with an image forming apparatus structured so that the developing apparatus 4 is removably mountable in the main assembly of the image forming apparatus, independently independent from the other processing means.

The intermediary transfer belt 5 as an intermediary transferring member is an endless belt. It is in contact with all of the four photosensitive drums 1, and rotates (circularly moves) in the direction (counterclockwise direction) indicated by an arrow mark B in the drawing. It is stretched around multiple supporting members (driver roller 51, auxiliary secondary transfer roller 52, follower roller 53), being thereby supported by them.

On the inward side of the loop which the intermediary transfer belt 5 forms, four primary transfer rollers 8, as primary transferring means, are arranged in parallel so that they oppose the four photosensitive drums 1 one for one. The primary transfer roller 8 keeps the intermediary transfer belt 5 against the photosensitive drum 1, forming thereby a primary transfer portion N1 (primary transfer nip), which is the area of contact between the intermediary transfer belt 5 and peripheral surface of the photosensitive drum 1. To the primary transfer roller 8, bias which is opposite in polarity to the normal polarity to which toner is charged is applied from an unshown primary transfer bias power source (high voltage power source), which is the means for applying the primary transfer bias. As the primary transfer bias is applied to the primary transfer roller 8, the toner image on the photosensitive drum 1 is transferred (primary transfer) onto the intermediary transfer belt 5.

On the outward side of the loop which the intermediary transfer belt 5 forms, a roller 9 (secondary transfer roller) for the secondary transfer, which is the means for transferring a toner image for the second time, is disposed so that it opposes an auxiliary secondary transfer roller 52. The secondary transfer roller 9 presses the intermediary transfer belt 5 against the auxiliary secondary transfer roller 52, forming thereby the transfer portion N2 (transfer nip), which is the area of contact between the intermediary transfer belt 5 and secondary transfer roller 9, where a toner image is transferred for the second time. To the secondary transfer roller 9, bias which is opposite in polarity to the normal polarity to which toner is charged, is applied from an unshown secondary transfer bias power source (high voltage power source), which is the means for applying the secondary transfer bias. As the secondary transfer bias is applied to the secondary transfer roller 9, the toner image on the intermediary transfer belt 5 is transferred (secondary transfer) onto a sheet of recording medium 12. The transfer rollers 8 and 9, which are the transfer rollers for the first and secondary transfers, respectively, are the same in structure.

The image forming operation carried out by the image forming apparatus in this embodiment is as follows: First, the peripheral surface of the photosensitive drum 1 is uniformly charged by the charge roller 2. Next, the charged peripheral surface of the photosensitive drum 1 is scanned (exposed) by the beam of laser light emitted by the scanner unit 3 while being modulated according to the pictorial information. As a result, an electrostatic image, in accordance with the pictorial information, is formed on the photosensitive drum 1. Then, the electrostatic image on the photosensitive drum 1 is developed by the development unit 4 into a visible image, that is, an image formed of toner (which hereafter will be referred to as toner image). The toner image on the photosensitive drum 1 is transferred (primary transfer) onto the intermediary transfer belt 5 by the function of the transfer roller 8.

For example, when the image forming apparatus is in the full-color image formation mode, the above described processes are sequentially carried out in the first through fourth image forming portions SY, SM, SC, and SK so that toner images different in color are sequentially transferred (primary transfer) in layers onto the intermediary transfer belt 5.

Thereafter, a recording medium 12 is conveyed to the secondary transfer portion N2 in synchronism with the movement of the intermediary transfer belt 5. The toner images on the intermediary transfer belt 5, which are different in color, are transferred together (secondary transfer) onto the recording medium 12 by the function of the secondary transfer roller 9, which is kept pressed against the intermediary transfer belt 5 with the presence of the recording medium 12 between the secondary transfer roller 9 and intermediary transfer belt 5.

After the transfer of the toner images onto the recording medium 12, the recording medium 12 is conveyed to the fixing apparatus 10 as a fixing means. In the fixing apparatus 10, the toner images are fixed to the recording medium 12 by the application of heat and pressure to the recording medium 12 and the toner images thereon.

The residual toner remaining on the photosensitive drum 1 after the primary transfer step is removed by the cleaning member 6 and is recovered into a chamber for the removed toner (which will be described later). The residual toner remaining on the intermediary transfer belt 5 after the secondary transfer step is removed by a cleaning apparatus 11, which is an apparatus for cleaning the intermediary transfer belt 5.

The image forming apparatus 100 is designed so that it can form a monochromatic or multicolor image, with the use of only one, or two or more (but not necessarily all) of the image forming portions.

[Process Cartridge]

Figure 2:
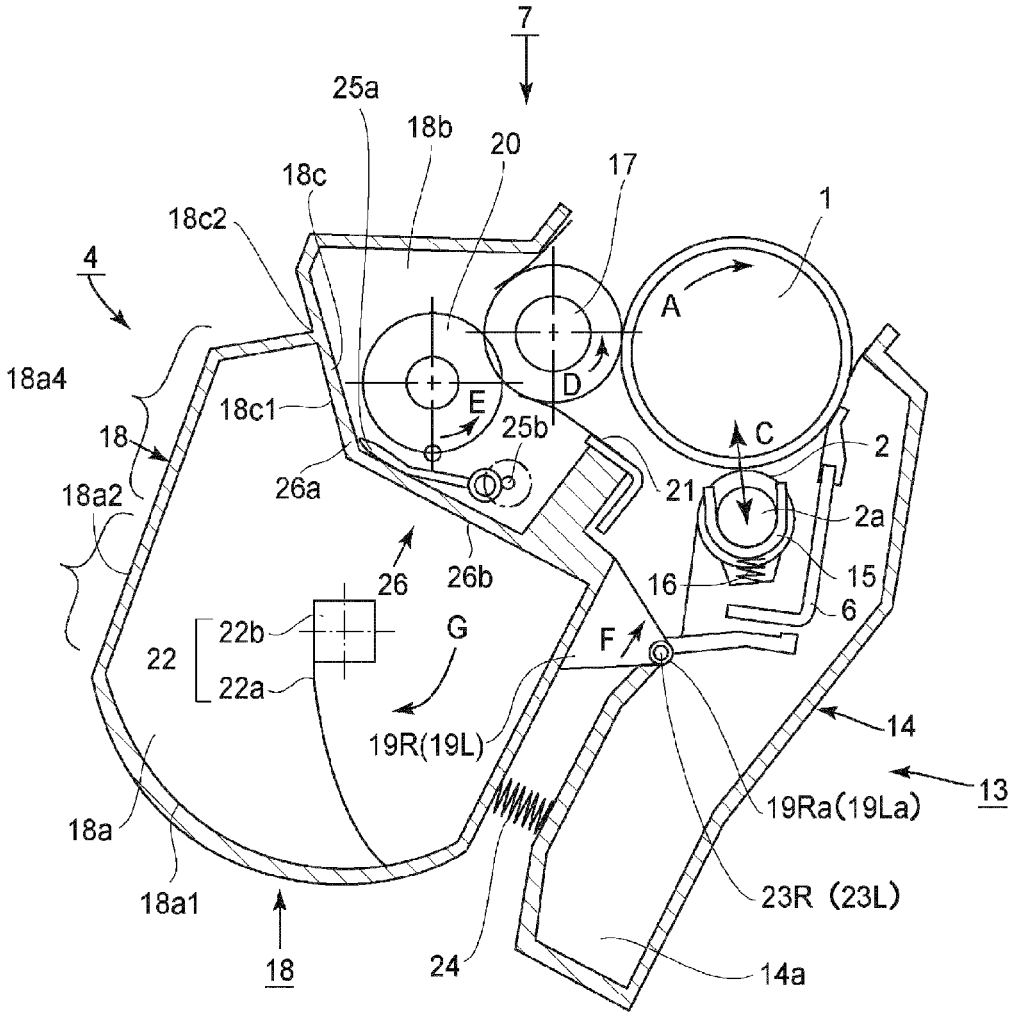
FIG. 2 is a cross-sectional view of the process cartridge in the first preferred embodiment of the present invention.

Next, the process cartridge 7 which is to be mounted in the image forming apparatus 100 will be described regarding its general structure. FIG. 2 is a schematic sectional (cross-sectional) view of the process cartridge, at a plane perpendicular to the lengthwise direction (rotational axis direction) of the photosensitive drum 1. The four process cartridges 7, which the image forming apparatus 100 requires for image formation and which are different in the color of the developer they contain, are practically identical in structure and operation, although they are different in the color of the developer they contain.

The process cartridge 7 has a photosensitive member unit 13 having the photosensitive drum 1, etc., and the development unit 4 having a development roller 17, etc.

The photosensitive member unit 13 has a cleaning means frame 14, which is a frame for supporting various components of the photosensitive member unit 13. The photosensitive drum 1 is rotatably supported by the cleaning means frame 14 with the interposition of unshown bearings. The photosensitive drum 1 is rotationally driven in the direction (clockwise direction) indicated by an arrow mark A in the drawing, by the driving force which it receives from an unshown motor as a photosensitive drum driving means (driving force source).

The photosensitive member unit 13 also includes the charge roller 2 and cleaning member 6, which are attached to the cleaning means frame 14 so that they remain in contact with the peripheral surface of the photosensitive drum 1. The photosensitive member unit 13 is also provided with a chamber 14*a* for removed toner, which is for storing the transfer residual toner removed from the peripheral surface of the photosensitive drum 1 by the cleaning member 6. The chamber 14*a* for removed toner is a part of the internal space of the cleaning means frame 14. The photosensitive member unit 13 is structured so that the transfer residual toner removed from the peripheral surface of the photosensitive drum 1 by the cleaning member 6 falls into the chamber 14*a* for removed toner.

Further, the cleaning means frame 14 holds charge roller bearings 2, which are attached to the cleaning means frame 14 so that the axial line of the bearings 2 are parallel to the rotational axes of the charge roller 2 and photosensitive drum 1. More specifically, the charge roller bearings 15 are disposed so that they can be moved in the direction indicated by an arrow mark C. The rotational shaft 2*a* of the charge roller 2 is rotatably held by the charge roller bearings 15. Further, each charge roller bearing 15 is kept pressed toward the photosensitive drum 1 by a charge roller pressing spring 16 as a pressure generating means.

As for the development unit 4, it has a developing means frame 18, which is a frame for supporting various components of the development unit 4. The development unit 4 includes the development roller 17, which is a developer bearing member and is rotated in contact with the peripheral surface of the photosensitive drum 1 in the direction (counterclockwise direction) indicated by an arrow mark D. That is, in this embodiment, the relationship, in terms of rotational direction, between the development roller 17 and photosensitive drum 1 is such that the direction in which the peripheral surface of the development roller 17 moves in the area of contact between the development roller 17 and photosensitive drum 1 is the same (upward in this embodiment) as the direction in which the peripheral surface of the photosensitive drum 1 moves in the area of contact between the development roller 17 and photosensitive drum 1. The development roller 17 is rotatably supported by its lengthwise end portions (in terms of rotational axis direction), by the developing means frame 18, with the interposition of lateral plates 19 (19R and 19L) which are attached to the right and left sides of the developing means frame 18, respectively. Incidentally, in this embodiment, the development roller 17 is disposed in contact with the photosensitive drum 1. However, the present invention is also compatible to a process cartridge (image forming apparatus) in which a preset amount of microscopic gap is kept between its photosensitive drum and development roller.

The development unit 4 also includes a toner supply roller 20, which is a developer supply roller and rotates in the direction (counterclockwise direction) indicated by an arrow mark E in the drawing. The toner supply roller 20 contacts the peripheral surface of the development roller 17. In this embodiment, the toner supply roller 20 and development roller 17 are rotated so that the direction in which the peripheral surface of the toner supply roller 20 moves in the area of contact between the two rollers is opposite to the direction in which the peripheral surface of the development roller 17 moves in the area of contact between the two rollers. The toner supply roller 20 supplies the peripheral surface of the development roller 17 with toner, and also, strips away from the peripheral surface of the development roller 17, the toner remaining on the peripheral surface of the development roller 17, that is, the toner on the peripheral surface of the development roller 17, which was not used for development. Further, the development unit 4 includes a development blade 21, which is a member for regulating in thickness the toner layer formed on the peripheral surface of the development roller 17 by the toner supplied onto the peripheral surface of the thickness by the toner supply roller 20. The development blade 21 makes contact with the peripheral surface of the development roller 17.

A toner storage chamber 18*a*, as a developer storage chamber, which is a part of the internal space of the developing means frame 18, stores nonmagnetic single component developer, that is, toner. There is a toner conveying member 22, which is rotatably supported in the toner storage chamber 18*a*, by the developing means frame 18. As will be described later, the toner conveying member 22 stirs the toner in the toner storage chamber 18*a*, and conveys the toner to the development chamber 18*b* in which the above described development roller 17 and toner supplying roller 20 are disposed. Incidentally, this embodiment of the present invention is also compatible with a toner cartridge (developer container), which is removably mountable in the apparatus main assembly and has only the toner storage chamber 18*a* and toner conveying member 22.

The development unit 4 is attached to the photosensitive member unit 13 with the use of a pair of connective pins 23 (23R and 23L) which are placed through the holes 19*a* (19Ra and 19La) of the lateral plates 19 (19R and 19L) of the development unit 4, respectively, so that both units are pivotally movable relative to each other. When the image forming apparatus 100 is in an image forming operation, the development unit 4 is kept pressured by the compression springs 24, as means for pressing the development unit, in the direction of rotation about the connective pins 23 in the direction (clockwise direction) indicated by an arrow mark F. Therefore, the development roller 17 is kept in contact with the photosensitive drum 1.

[Structure of Toner Conveying Member]

Next, the structure of the toner conveying member of the development unit 4 of the process cartridge 7 in this embodiment will be described in detail.

Incidentally, in this specification, terms, such as "upward", "downward", "vertical", and "horizontal", which indicate the directions regarding the structure of the development unit 4 (developing apparatus) or process cartridge 7, means the upward, downward, vertical, and horizontal direction of the entirety, or a given member (component) of the development unit 4 or process cartridge 7, which is in the normal state of usage. That is, the normal state of usage of the development unit (developing apparatus) or process cartridge means the state in which they are in when they are in their proper positions in the main assembly of a properly positioned image forming apparatus and are ready for image formation.

Figure 3:
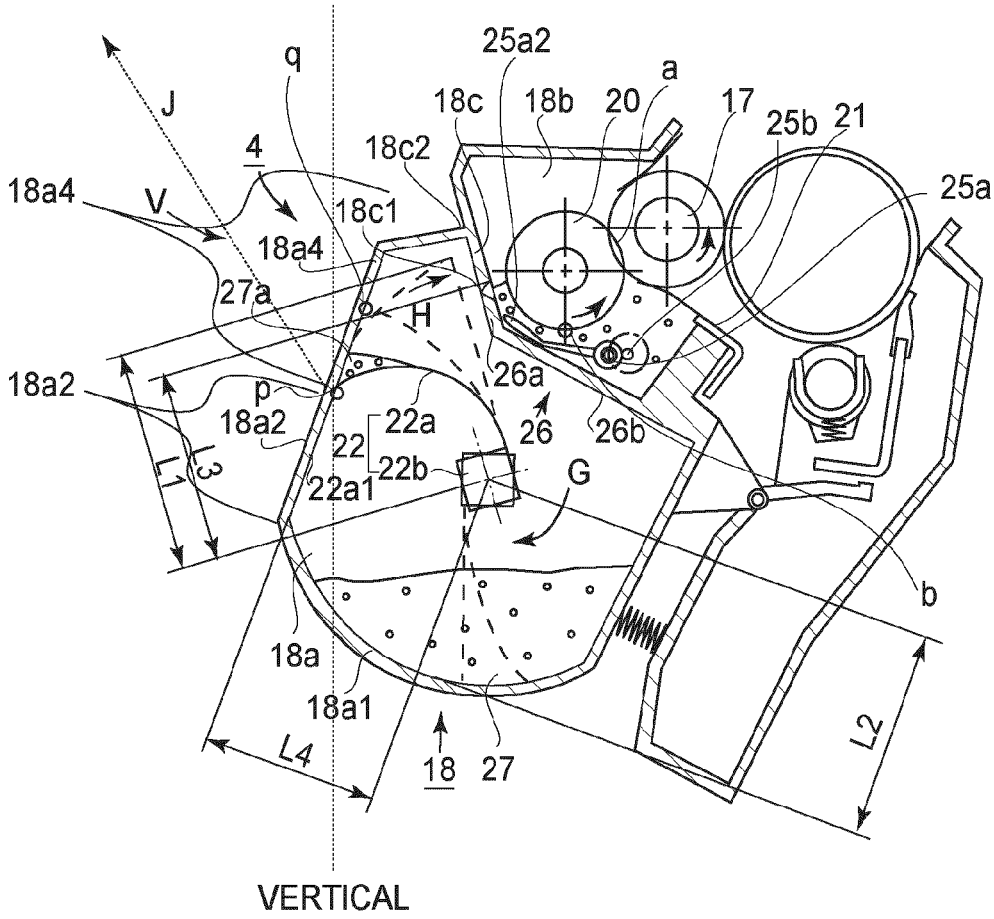
FIG. 3 is also a cross-sectional view of the process cartridge in the first preferred embodiment of the present invention.

FIG. 3 is a schematic cross-sectional view of the process cartridge 7 in which toner is being conveyed.

The development unit 4 has the development chamber 18*b* and toner storage chamber 18*a*, as described above. There are the development roller 17, toner supplying roller 20, development blade 21, etc., in the development chamber 18*b*. The toner storage chamber 18*a* contains the toner to be supplied to the development chamber 18*b*, and a toner conveying member 22 (sheet-like member) for conveying toner to the development chamber 18*b*. The toner storage chamber 18*a* is under the development chamber 18*b*. Therefore, the toner must be conveyed from the toner storage chamber 18*a* to the development chamber 18*b* against gravity.

As described above, it has been difficult to come up with a toner conveying mechanism (means) which is small, simple in structure, and yet, capable of efficiently and satisfactorily conveying toner in a development unit structured such that toner must be conveyed against gravity. Failure in satisfactorily conveying toner to the development chamber 18*b*, in which the development roller 17 and toner supplying roller 20 are located, results in the formation of an image which suffers from unwanted white spots (attributable to a phenomenon where points on the peripheral surface of photosensitive member, to which toner is to be adhered, fail to be supplied with toner), or defects of the like.

Thus, one of the objects of the present invention is to provide a toner (developer) conveying mechanism (means) which is simple, inexpensive, and small, and yet, capable of efficiently and satisfactorily conveying toner in a development unit structured such that toner must be conveyed against gravity, in order to prevent the formation of a defective image, more specifically, an image suffering from unwanted white spots attributable to the unsatisfactory delivery of toner, or defects of the like.

As one of the means to achieve the above described object, the development unit 4 in this embodiment is structured as follows. That is, the development unit 4 has the development chamber 18*b* and toner storage chamber 18*a*, which are parts of the internal space of the developing means frame 18. The development chamber 18*b* has the development roller 17 and toner supplying roller 20. The toner storage chamber 18*a* is under the development chamber 18*b*. The toner storage chamber 18*a* stores the toner to be supplied to the development chamber 18*b*. There is a partition wall 26 between the development chamber 18*b* and toner storage chamber 18*a*. The partition wall 26 has a hole 18*c* as the toner passage. Although hole 18*c* is shown in several figures of the drawings, it may be most clearly illustrated in FIG. 4, where it is shown positioned relative to toner conveying member 22. The hole 18*c* is positioned so that its position matches the top portion of the toner storage chamber 18*a*. There is the toner conveying member 22 in the toner storage chamber 18*a*. The toner conveying member 22, which is elastic, is for supplying toner to the development chamber 18*b*. It is rotatably supported.

The toner storage chamber 18*a* is provided with a guiding portion 18*a*2, which is the portion of the wall of the toner storage chamber 18 which causes the toner conveying member 22 to resiliently bend (deform), and with which the toner conveying member 22 makes contact as it is rotated. The guiding portion 18*a*2 is located below the hole 18*c*. As the toner conveying member 22 is rotated, it comes into contact with the guiding portion 18*a*2, receiving therefore the reactive force from the guiding portion 18*a*2. As a result, the toner conveying member 22 bends (deforms) against its resiliency. Further, as the toner conveying member 22 is rotated in contact with the guiding portion 18*a*2, it conveys toner by holding the toner on its downstream surface, in terms of its rotational direction. Referring to FIG. 3, in this embodiment, the guiding portion 18*a*2 is the portion of the straight portion of the internal surface of the toner storage chamber 18*a*, which is between the bottom end of the straight portion and the point p at which the toner conveying member 22 separates from the straight portion. Further, the toner storage chamber 18*a* has a toner conveying member recovery space (which hereafter may be referred to simply as recovery space), which corresponds to a portion 18*a*4 of the internal surface of the toner storage chamber 18*a*. The portion 18*a*4 is on the immediately downstream side of the guiding portion 18*a*2 and on the immediately upstream side of the hole 18*c*, in terms of the rotational direction of the toner conveying member 22. The recovery space, which corresponds to the portion 18*a*4, is the space in which there is no contact between the toner conveying member 22 and the internal surface of the toner storage chamber 18*a*. In this embodiment, the portion 18*a*4 (which hereafter may be referred to as recovery portion 18*a*4) to which the recovery space corresponds, is the portion of the internal surface of the toner storage chamber 18*a*, which is between the above-mentioned point p and hole 18*c*. Further, the recovery portion 18*a*4 is above the horizontal plane which includes the rotational axis of the toner conveying member 22. In other words, the development unit 4 is structured so that the border line 18*a*3 is at the same level as the horizontal plane which includes the rotational center of the toner conveying member 22, or is above the horizontal plane.

Therefore, as the sweeping edge moves past the downstream end of the guiding portion 18*a*2, the sweeping edge portion (portion next to internal surface of toner storage chamber 18*a*) of the toner conveying member 22 separates from the internal surface of the toner storage chamber 18*a*. As the toner conveying member 22 separates from the internal surface of the toner storage chamber 18*a*, it recovers from its deformation attributable to its contact with the internal surface of the toner storage chamber 18*a*, due to its own resiliency; the toner conveying member 22 changes its shape in a manner to restore its normal shape. This change in the shape of the toner conveying member 22 in a manner to restore its normal shape causes the toner on the downstream surface of the toner conveying member 22, which is being conveyed by the toner conveying member 22, to catapult against gravity toward the hole 18*c* (which is on downstream side of recovery portion 18*a*4, in terms of rotational direction of toner conveying member 22).

The point p corresponds to the border portion 18*a*3 (border line) between the guiding portion 18*a*2 and recovery portion 18*a*4. Further, the development unit 4 is structured so that the border line 18*a*3 is at a lower level than the bottom edge 18*c*1 (that is, the lowest point) of the hole 18*c*. As soon as the toner conveying member 22 separates from the border line 18*a*3, its resiliency causes it to rotate into the area in which it can contact the edge portion of the hole 18*c*. Thus, at the moment the toner conveying member 22 separates from the border line 18*a*3, its resiliency causes it to bump into the edge portion of the hole 18*c*, ensuring thereby that the toner catapults into the hole 18*c*.

Further, the development unit 4 is structured so that the border line 18*a*3 is at a level higher than the horizontal plane which includes the rotational center of the toner conveying member 22.

Therefore, the development unit 4 in this embodiment can efficiently and satisfactorily convey toner against gravity, while being small and simple in structure. Next, the development unit 4 in this embodiment will be described in more detail.

The developing means frame 18 has the partition wall 26, which separates the development chamber 18*b* from the toner storage chamber 18*a*. In this embodiment, the partition wall 26 is made up of a first portion 26*a* and second portion 26*b*. The first portion 26*a* is more tilted relative to the horizontal plane than the second portion 26*b*, and is located on the lateral side (left side in drawing) of the toner supply roller 20. The second portion 26*a* is less tilted relative to the horizontal plane than the first portion 26*a*, and is below the toner supply roller 20. Tilting the partition wall 26 relative to the horizontal plane improves the efficiency with which toner is conveyed in the development chamber 18*b*. In particular, in this embodiment, the partition wall 26 is made up of the first and second portions 26*a* and 26*b*, which are different in the angle relative to the horizontal plane, being therefore greater in the surface area facing the toner supply roller 20 than the partition wall (26) of a process cartridge in accordance with the prior art. Therefore, the development chamber 18*b* in this embodiment is greater in the amount of the toner in the adjacencies of the toner supply roller 20, being therefore greater in the amount by which toner is supplied to the toner supply roller 20, than a development chamber in accordance with the prior art.

The first portion 26*a* of the partition wall 26, which is on the opposite side of the toner supply roller 20 from the area of contact between the toner supply roller 20 and development roller 17, is provided with the hole 18*c*, through which the toner in the toner storage chamber 18*a* is conveyed into the development chamber 18*b*. In this embodiment, the toner supply roller 20 rotates so that the portion of its peripheral surface, which is facing the hole 18*c*, moves in the downward direction. That is, the rotation of the toner supply roller 20 is such that the toner supplied to the development chamber 18*b* through the hole 18*c* is captured by the portion of the peripheral surface of the toner supply roller 20, which is downwardly moving along the partition wall 26. Further, the development unit 4 is structured so that the bottom edge 18*c*1 of the hole 18*c* is at a level higher than the bottom end 20*b* of the toner supply roller 20. Thus, the vertical position of the top surface of the body of toner in the development chamber 18*b* is dependent upon the vertical position of the bottom edge 18*c*1 of the hole 18*c*. Therefore, the top surface of the body of toner in the development chamber 18*b* is at a level higher than the vertical position of the bottom end of the toner supply roller 20. Therefore, the development unit 4 in this embodiment is greater in the size of the area of contact between the peripheral surface of the toner supply roller 20 and the body of toner in the development chamber 18*b*, being therefore greater in the efficiency with which toner is supplied to the toner supply roller 20, than a development unit in accordance with the prior art.

The toner storage chamber 18*a* contains the toner conveying member 22, that is, the toner conveying member for conveying toner into the development chamber 18*b*, which is rotatably supported. More specifically, the toner conveying member 22 is rotatably supported in the toner storage chamber 18*a* by its lengthwise end portions (in terms of direction of its rotational axis), by the developing means frame 18 which includes the toner storage chamber 18*a*. The toner conveying member 22 is rotationally driven in the direction (clockwise direction) indicated by an arrow mark G in the drawing, by an unshown driving means (driving force source).

The toner conveying member 22 has a sheet portion 22*a* and a sheet supporting shaft 22*b* (rotational shaft). The sheet portion 22*a* is the portion which actually conveys toner, and is flexible. The shaft 22*b* is the portion to which the sheet portion 22*a* is attached, and through which the toner conveying member 22 receives rotational driving force. The shaft 22*b* extends in the direction roughly parallel to the lengthwise direction (direction parallel to their axial lines) of the photosensitive drum 1, development sleeve 17, and toner supply roller 20, across the entire range of the toner storage chamber 18*a* in terms of the lengthwise direction of the toner storage chamber 18*a*. The sheet portion 22*a* is made up of a single sheet (plate-like member) of a resinous substance, which extends in the lengthwise direction (direction parallel to axial line of shaft portion 22*b*) of the shaft portion 22*b* across roughly the entire range of the shaft portion 22*b*. The sheet portion 22*a* is attached to the shaft portion 22*b* by one of its edges which are roughly parallel to the lengthwise direction of the shaft portion 22*b* (one of the edges perpendicular to the radius of its sweeping area, that is, perpendicular to its width direction).

The preferable material for the sheet portion 22*a* is a flexible sheet (film) formed of a resinous substance, such as polyester, polyphenylene sulfide or polycarbonate, for example. It is preferable that the thickness of the sheet portion 22*a* is in a range of 50 μm-250 μm.

The distance L1, which is the distance from the rotational center of the toner conveying member 22 to the sweeping edge of the sheet portion 22*a*, is greater than a distance L2, which is the distance in a straight line from the rotational center of the toner conveying member 22 to the internal surface 18*a*1 of the toner storage chamber 18*a*. The above-mentioned distance L1 is equivalent to the maximum value of the radius of the sweeping area of the toner conveying member 22, that is, the radius of the toner conveying member 22 when the sheet portion 22*a* is in the natural form, that is, when the sheet portion 22*a* is not in the deformed (bent) state. A distance L2 is the maximum value of the distance in a straight line from the above-mentioned rotational center to the portion 18*a*1 of the internal surface of the toner storage chamber 18*a*, with which the sheet portion 22*a* comes into contact. Further, a distance L1 is greater than a distance L3, which is the distance in a straight line from the above-mentioned rotational center to the bottom edge 18*c*1 (that is, lowest point of hole 18*c*) of the hole 18*c*. Therefore, it is ensured that toner is sent to the hole 18*c*. A distance L4, which is the distance in a straight line from the above-mentioned rotational center to the guiding portion 18*a*2, is smaller than the length L2, which is the maximum value of the distance in a straight line from the above-mentioned rotational center to the portion 18*a*1 of the internal surface of the toner storage chamber 18*a*. That is, in this embodiment, the above-mentioned distances L1, L2, L3, and L3 L4 satisfy the following relationship:

$$L1>L2 \quad (1)$$

$$L1>L3 \quad (2)$$

$$L2>L4 \quad (3)$$

With Inequality (1), that is, L1>L2, given that it is satisfied, as the toner conveying member 22 is rotated, the sheet portion 22*a* comes into contact with the portion 18*a*1 of the internal surface of the toner storage chamber 18*a*, and is substantially bent by the portion 18*a*1. Then, as the toner conveying member 22 is further rotated, the body of toner swept up by the sheet portion 22*a* is conveyed by the rotation of the toner conveying member 22. That is, the body of toner, which is conveyed by the toner conveying member 22, is the body of toner in a wedge-like area 27, that is, the area surrounded by the hypothetical extension of the surface of the straight portion (portion which is not bent in curvature) of the sheet portion 22*a*, the bent portion of the sheet portion 22*a*, and the portion 18*a*1 of the internal surface of the toner storage chamber 18*a*.

Further, with Inequality (2), that is, L2>L4, given that it is satisfied, as the toner conveying member 22 is rotated further, the sheet portion 22*a* comes into contact with the guiding portion 18*a*2, and is bent in curvature by the guiding portion 18*a*2. Then, as the toner conveying member 22 is rotated further, the body of toner swept up by the sheet portion 22*a*, that is, the body of toner on the downstream side of the sheet portion 22*a* in terms of the rotational direction of the toner conveying member 22, is conveyed into the development chamber 18*b*. That is, the body of toner, which is conveyed into the development chamber 18*b*, is the body of toner in the area 27*a*, that is, the wedge-shaped area surrounded by the dotted line (hypothetical line) which represents the surface of the straight portion (portion which has not bent in curvature) of the sheet portion 22*a*, the surface of the sheet portion 22*a* which is bent in curvature due to its contact with the guiding portion 18*a*2, and the dotted line (hypothetical line) which represents the locus of the sweeping edge of the sheet portion 22*a*.

The toner storage chamber 18*a* has the above-mentioned toner conveying member recovery space, which corresponds to the portion 18*a*4 of the internal surface of the toner storage chamber 18*a*, and in which the sweeping edge 22*a*1 of the sheet portion 22*a* does not contact. In terms of the rotational direction G of the toner conveying member 22, the recovery portion 18*a*4 is on the downstream side of the guiding portion 18*a*2 and on the upstream side of the top end 18*c*2 of the hole 18*c*. The recovery portion 18*a*4 is a part of the internal surface of the toner storage chamber 18*a*, which the sheet portion 22*a* does not contact. Further, the development unit 4 is structured so that the recovery portion 18*a*4 is at a level higher than the above described border (point p) (or on a downstream side of border (point p) in terms of the rotational direction G). Here, the intersection between a hypothetical circle, which represents the locus of the sweeping edge 22*a*1 of the sheet portion 22*a* which is in the natural state (state prior to deformation), and the internal surface of the toner storage chamber 18*a*, which includes the guiding portion 18*a*2, will be referred to as a point q. Further, the development unit 4 in this embodiment is structured so that the point p is at a level lower than the point q (or on upstream side of point q in terms of rotational direction G), for the following reason. That is, the sheet portion 22*a* is bent in curvature by the friction between the sheet portion 22*a* and internal surface of the toner storage chamber 18*a*, and also, by the weight of toner. Therefore, the point at which the sheet portion 22*a* separates from the internal surface of the toner storage chamber 18*a* is on the upstream side of the point q, in terms of the rotational direction G. Further, the development unit 4 is structured so that the border (point p), that is, the top end of the guiding portion 18*a*2, is at a level lower than the bottom edge 18*c*1 of the hole 18*c*, and also, so that when the sheet portion 22*a* is in the recovery space, that is, the space corresponding to the portion 18*a*4 of the internal surface of the toner storage chamber 18*a*, the sweeping edge 22*a*1 of the sheet portion 22*a* does not contact the internal surface of the toner storage chamber 18*a*.

As the toner conveying member 22 rotates, the sweeping edge 22*a*1 of its sheet portion 22*a* moves in the rotational direction G through the range corresponding to the guiding portion 18*a*2. As the sheet portion 22*a* becomes free from the force which kept it deformed (bent in curvature), it snaps back into its natural shape due to its resiliency. As a result, the toner on the sheet portion 22*a* is catapulted in the direction indicated by an arrow mark H in FIG. 3, that is, toward the hole 18*c* of the partition wall 26.

Further, with the above-mentioned Inequality (2), that is, L1>L3, being satisfied, the movement of the sheet portion 22*a* relative to the hole 18*c* is as follows. That is, after the sheet portion 22*a* becomes free from the force which kept it deformed (bent in curvature), that is, after the sheet portion 22*a* restores its natural shape, the sheet portion 22*a* reaches the hole 18*c*. The moment the sheet portion 22*a* reaches the hole 18*c*, the sweeping edge 22*a*1 of the sheet portion 22*a* is at a level higher than the bottom edge 18*c*1 of the hole 18*c*. Therefore, it is ensured that the moment the sheet portion 22*a* becomes free from the force which kept it deformed (bent in curvature), the body of toner having collected on the sweeping edge portion of the sheet portion 22*a* is conveyed to the development chamber 18*b*. Therefore, the toner supplying roller 20 is supplied with a satisfactory amount of toner, making it possible to prevent the formation of a defective image, more specifically, an image suffering from unwanted white spots or the like attributable to the insufficiency in toner supply delivery. However, satisfying the above-mentioned Inequality (2), that is, L1>L3, is only one of the measures for efficiently conveying toner into the development chamber 18*b*, and is not a requisite in the case of this embodiment in which the development unit 4 is structured so that toner is catapulted by the force generated by the resiliency of the sheet portion 22*a*.

Further, satisfying the above-mentioned Inequality (3), that is, L2>L4, increases the extent by which the sheet portion 22*a* is made to elastically deform (in curvature) when it moves through the range corresponding to the guiding portion 18*a*2. Therefore, it causes the sheet portion 22*a* to catapult the toner better.

Figure 4:
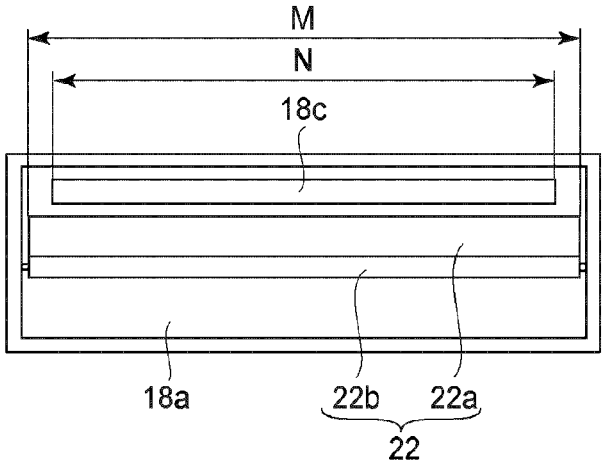
FIG. 4 is a schematic drawing of the toner conveying member of the process cartridge in the first preferred embodiment of the present invention, showing the structure of the toner conveying member.

FIG. 4 is a schematic drawing of the toner conveying member 22, as seen from the direction indicated by an arrow mark V in FIG. 3, showing the structure of the toner conveying member 22. It is preferable that a length M, that is, the length of the sheet portion 22*a*, is greater than a length N, that is, the length of the hole 18*c*.

Incidentally, in this embodiment, the development unit 4 is structured so that when the sweeping edge portion of the toner conveying member 22 is in contact with the border 18*a*3, the extension of the normal line (indicated by arrow mark J in FIG. 3) to the sweeping edge, in the downstream direction, in terms of the rotational direction of the toner conveying member 22, is on the opposite side of the vertical plane, which includes the sweeping edge, from the hole 18*c*. The employment of this structural arrangement can increase the amount by which toner is retained on the toner conveying member 22 up to immediately before the toner is catapulted. Therefore, the employment of this structural arrangement makes it possible to more efficiently convey toner to the hole 18*c*.

As described above, practically, the toner conveying member 22 in this embodiment is made up of nothing but the sheet portion 22*a* and sheet portion supporting shaft 22*b*. That is, it is very simple in structure. Therefore, it is less expensive than a conventional means, such as a screw, for conveying toner upward.

Further, in this embodiment, the sheet portion 22*a* of the toner conveying member 22 is formed of an elastic sheet. Therefore, the toner is catapulted by the force generated by the resiliency of the sheet portion 22*a*. Thus, the toner storage chamber 18*a* in this embodiment is significantly smaller than that of a cartridge in accordance with the prior art, which is structured so that toner is conveyed to the development chamber 18*b* by a stirring member or the like while remaining held by the stirring member. Incidentally, the smaller the toner storage chamber 18*a*, the smaller the developing apparatus 4, process cartridge 7, and image forming apparatus 100 can be made.

Also in this embodiment, the toner is satisfactorily conveyed against gravity. In other words, this embodiment makes it possible to realize an image forming apparatus structured so that the process cartridge 7 is directly below the intermediary transfer belt 5. Therefore, this embodiment makes it possible to dispose the scanner unit 3, for example, away from the fixing apparatus 10 in order to prevent the heat from the fixing apparatus 10 from affecting the scanner unit 3, or to eliminate or reduce the space necessary for reducing the effects of the heat from the fixing apparatus 10 upon the scanner unit 3. Therefore, this embodiment can reduce in size (height, for example) the image forming apparatus 100. Further, this embodiment makes it possible to dispose the fixing apparatus above and away from the developing apparatus 4 and process cartridge 7, with the presence of the intermediary transfer belt 5 between the fixing apparatus 10 and developing apparatus 4, and between the fixing apparatus 10 and process cartridge 7. Therefore, this embodiment of the present invention can reduce the effects of the heat from the fixing apparatus 10 upon the developing apparatus 4 and process cartridge 7, or to eliminate or reduce the space necessary for reducing the effects of the heat from the fixing apparatus 10 upon the developing apparatus 4 and process cartridge 7. Therefore, this embodiment can reduce in size (height, for example) the image forming apparatus 100.

[Structure of Mechanism for Stirring Toner in Development Chamber]

Figure 5:
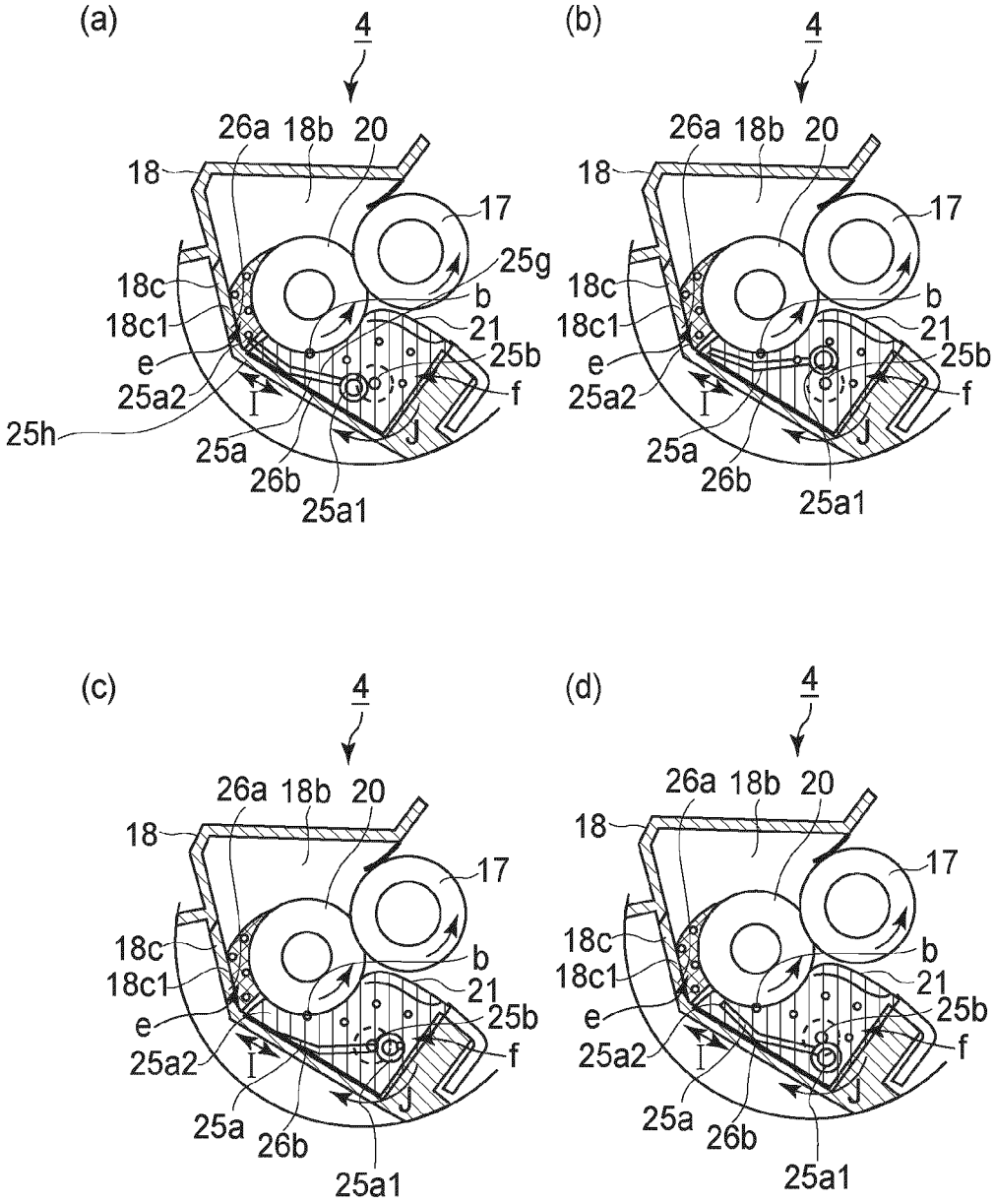
FIG. 5 is a cross-sectional view of a part of the process cartridge in the first embodiment of the present invention, showing how toner is being stirred in the development chamber.

Next, the structure of the mechanism for stirring the toner in the development chamber 18*b* will be described. FIGS. 5(*a*)-5(*d*) are cross-sectional views of the development chamber 18*b*, more specifically, the toner stirring member, and its adjacencies, in the development chamber 18*b*, showing the structure of the mechanism for stirring the toner in the development chamber 18*b*.

Regarding the flow and circulation of the toner in the development chamber 18*b*, the development unit 4 is provided with a developer stirring member, which is in the adjacencies of both the development roller 17 and the developer supply roller 20 which supplies the development roller 17 with toner. The placement of the stirring member in the above-mentioned area of the development chamber 18*b* prevents the phenomenon called "toner packing", that is, the phenomenon that toner is compacted to an unnecessarily high level of density. Therefore, not only is development roller 17 is continuously supplied with a proper amount of toner by the toner supply roller 20, but also, the toner layer on the development roller 17 remains stable in thickness.

An image forming apparatus can be improved in image quality by reliably providing the development roller 17 with a proper amount of toner by preventing toner from being compacted, and by improving the toner circulation in the adjacencies of the peripheral surface of the development roller 17 and toner supply roller 20. On the other hand, if the toner supply to the development roller 17 becomes unstable, the image forming apparatus sometimes forms a defective image, more specifically, an image suffering from nonuniformity or the like.

Thus, one of the primary objects of this embodiment is to improve a process cartridge 7 in the toner circulation in the adjacencies of the development roller 17, etc., in order to prevent an image forming apparatus from forming an unsatisfactory image, more specifically, an image suffering from the nonuniformity attributable to unsatisfactory toner delivery.

Thus, in this embodiment, the development unit 4 as structured will be described next. That is, in this embodiment, the development unit 4 is provided with a stirring member 25, which is in the development chamber 18*b*. The stirring member 25 has a stirring portion 25*a* and a stirring portion supporting shaft 25*b* (axle). The stirring portion supporting shaft 25*b* is rotatably supported by the walls of the development chamber 18*b*. The stirring portion 25*a* is rotatably supported by the stirring portion supporting shaft 25*b*, and is made to oscillate by the rotation of the stirring member supporting shaft 25*b*. In terms of the rotational direction of the toner supply roller 20, the stirring portion supporting shaft 25*b* is on the downstream side of the stirring portion 25*a*. This structural arrangement makes the downstream portion of the stirring portion 25*a* greater in movement than the upstream portion of the stirring portion 25*a*, in term's of the rotational direction of the toner supply roller 20. The stirring portion 25*a* is between the toner supply roller 20 and partition wall 26. The stirring portion 25*a* is provided with a through hole 25*c* as a toner passage. The stirring portion 25*a* is made to oscillate in such a manner to alternately repeat a stroke in which the hole 25*c* moves toward the toner supply roller 20 and a stroke in which the hole 25*c* moves away from the toner supply roller 20. In the stroke in which the hole 25*c* moves toward the toner supply roller 20, the portion of the stirring portion 25*a*, which is next to the hole 25*c*, moves the toner toward the toner supply roller 20, whereas in the stroke in which the hole 25*c* moves away from the toner supply roller 20, the body of toner, which is under the hole 25*c*, moves toward the toner supply roller 20 through the hole 25*c*. In other words, as the stirring portion 25*a* having the hole 25*c* oscillates, not only can it satisfactorily stir the toner, but also, it can satisfactorily supply the toner supply roller 20 with the loosened toner. Further, the stirring portion 25*a* also moves back and forth in the direction parallel to a line tangential to the peripheral surface of the toner supply roller 20. That is, the stirring portion 25*a* oscillates in the direction parallel to a line perpendicular to the radius direction of the developer supply roller 20. In other words, the stirring portion 25*a* also oscillates in the direction parallel to the rotational direction of the developer supply roller 20 (direction intersectional to rotational axis). The oscillation of the stirring portion 25*a* in this direction enhances the stirring function of the stirring portion 25*a*.

After toner is conveyed into the development chamber 18*b*, the toner is stored in a first area e and a second area f The first area e is between the toner supply roller 20 and a first portion 26*a* of the partition wall 26, and the second area f is surrounded by the toner supply roller 20, second portion 26*b* of the partition wall 26, and development blade 21. That is, the first area e of the development chamber 18*b* is the portion of the development chamber 18*b*, which is between the toner supply roller 20 and the portion of the partition wall 26, which is below the hole 18*c* and on the lateral side (on left side in drawing) of toner supply roller 20, whereas the second area f of the development chamber 18*b* is the area of the development chamber 18*b*, which is surrounded by the toner supply roller 20, the portion of the partition wall 26, which is below the toner supply roller 20, and a development blade 21. The toner supply roller 20 supplies the development roller 17 with the toner stored in the first and second areas e and f The above-mentioned stirring portion 25*a* is in the second area f. The stirring portion 25*a* is a piece of slightly angled plate, which is roughly L-shaped in cross section, that is, as seen from the direction parallel to the lengthwise direction of the development roller 17 and toner supply roller 20. That is, in this embodiment, the stirring portion 25*a* has a first flat portion 25*g* (first surface), a second flat portion 25*h* (second surface), and a bend 25*f*. The first flat portion 25*g* (first surface) extends in parallel to the rotational axis of the toner supply roller 20. The second flat portion 25*f* (second surface) holds a preset angle relative to the first flat portion 25*g*, and also extends in parallel to the rotational axis of the toner supply roller 20. In other words, the first and second flat portions 25*g* and 25*f* intersect each other. The bend 25*f* is the portion between the first and second flat portion 25*g* and 25*f*; it is the joint (intersection) between the first and second flat portions 25*g* and 25*f*. In this embodiment, the stirring portion 25*a* is bent so that its bend 25*f* points outward of the development chamber 18*b*, in terms of the radius direction of the toner supply roller 20. That is, the recess formed by the first and second flat portions 25*g* and 25*h* faces the toner supply roller 20. The stirring portion 25*a* is formed of a resinous substance.

The above-mentioned stirring portion supporting shaft 25*b*, which is in the form of a crankshaft, is rotatably supported in the second area f. Further, the stirring portion 25*a* is rotatably supported by the crankshaft 25*b* (stirring portion supporting shaft 25*b*). The crankshaft 25*b* is more or less parallel to the lengthwise direction of the development roller 17 and toner supply roller 20, and extends from one lengthwise end of the development chamber 18*b* to the other. The crankshaft 25*b* is rotatably supported at its lengthwise end portions (end portions in terms of direction parallel to its rotational axis), by the developing means frame 18, to which the development chamber 18*b* belongs.

Incidentally, in this embodiment, the stirring portion 25*a* is formed of a resinous substance. However, the stirring portion 25*a* may be formed of a metallic substance.

The stirring portion 25*a* is rotatably attached to the crankshaft 25*b*, by its connective portions 25*a*1, which corresponds to one of the edges of the stirring portion 25*a*, in terms of the width direction of the stirring portion 25*a*. That is, in this embodiment, the stirring portion supporting shaft 25*b* of the stirring member 25 is in the form of a crankshaft, and the stirring portion 25*a* is rotatably attached to the portion of the stirring supporting shaft 25*b* which is equivalent to the crankpin portion of a crankshaft, being thereby rotatably supported by the portion equivalent to the crankpin portion, that is, the portion offset from the axial line of the crankshaft 25*b*. Referring to FIGS. 5(*a*)-5(*d*), as the crankshaft 25*b* is rotationally driven by an unshown driving means (driving force source), the free edge portion 25*a*2 of the stirring portion 25*a*, that is, the edge portion of the stirring portion 25*a*, which is not in engagement with the crankshaft 25*b*, shuttles in the direction indicated by an arrow mark I. That is, the stirring portion 25*a* reciprocally moves in the direction parallel to the line tangential to the peripheral surface of the toner supply roller 20.

Regarding the locus of the free edge portion 25*a*2 of the stirring portion 25*a*, the stirring member 25 is disposed so that as the stirring portion 25*a* is reciprocally moved as described above, its free edge portion 25*a*2 enters the first area e, and comes into contact with the body of toner in the first area e. In this embodiment, the partition wall 26 is made up of the first and second portions 26*a* and 26*b*, and the stirring portion 25*a* reciprocally moves in the space surrounded by the toner supply roller 20, and the first and second portions 26*a* and 26*b* of the partition wall 26, as described above. Therefore, it does not occur that after toner is supplied to the development chamber 18*b*, it becomes less fluid by being compacted in the first area e. Therefore, toner is more efficiently supplied to the second area f and the toner supply roller 20 than in a process cartridge in the prior art.

Incidentally, in this embodiment, the process cartridge 7 is structured so that the stirring portion 25*a* enters the first area e. However, this embodiment is not intended to limit the present invention in terms of the process cartridge structure. That is, as long as the process cartridge 7 is structured so that the problem where toner becomes compacted and remains compacted can be prevented by improving the toner circulation in the development chamber 18*b* by causing the free edge portion 25*a*2 of the stirring portion 25*a* to reciprocally move, it is not mandatory for the application of the present invention that the free edge portion 25*a*2 of the stirring portion 25*a* enters the first area e.

Further, in this embodiment, not only does the stirring portion 25*a* reciprocally move in the above described direction, but also, it oscillates in the direction parallel to the radius direction of the toner supply roller 20, that is, it alternately repeats the stroke in which the hole 25*c* moves toward the toner supply roller 20 and the stroke in which the hole 25*c* moves away from the toner supply roller 20. Thus, not only does the stirring portion 25*a* prevent the toner in the second area f from being compacted by stirring the toner, but it also pushes the toner toward the toner supply roller 20 (presses toner against toner supply roller 20). Next, the movement of the stirring portion 25*a* will be described, referring to FIG. 5. When the stirring portion 25*a* is in the state shown in FIG. 5(*a*), the tip portion of the free edge portion 25*a*2 (first pressing portion) presses the toner against the toner supply roller 20. When the stirring portion 25*a* is in the state shown in FIG. 5(*b*), the connective edge portion 25*a*1 (second pressing portion) of the stirring portion 25*a* presses the toner against the toner supply roller 20. Further, when the stirring portion 25*a* is in the state shown in FIG. 5(*d*), the tip portion (first pressing portion) of the free edge portion 25*a*2 again presses the toner against the toner supply roller 20. That is, the toner is pressed against the toner supply roller 20 by various areas (in terms of the rotational direction of the toner supply roller 20) of the stirring portion 25*a*. In other words, in this embodiment, the efficiency with which the toner supply roller 20 is supplied with toner is improved by the above described oscillation of the stirring portion 25*a*.

The effect of preventing the problem that toner becomes compacted in the first area e as described above, and the effect of improving the process cartridge 7 in the efficiency with which the toner supply roller 20 is supplied with toner as described above, can be achieved regardless of the rotational direction of the crankshaft 25*b*. In this embodiment, the crankshaft 25*b* is rotated by an unshown driving means (driving force source) in the direction (clockwise direction) indicated by the arrow mark J to oscillate (reciprocally move) the stirring portion 25*a*.

Figure 6:
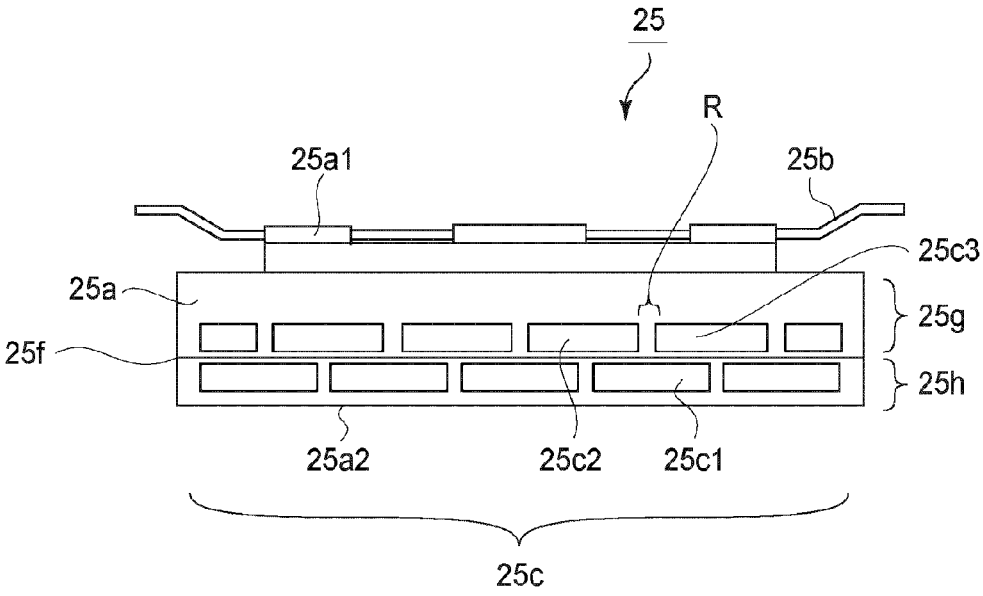
FIG. 6 is a front view of the stirring means of the process cartridge in the first preferred embodiment of the present invention.

FIG. 6 is a front view of the stirring member 25. The stirring portion 25*a* in this embodiment, which is in the form of a plate, is provided with multiple holes 25*c* (through holes), which face the toner supply roller 20. Further, the stirring portion 25*a* oscillates; it alternately repeats the stroke in which the holes 25*c* move toward the toner supply roller 20 and the stroke in which the holes 25*c* move away from the toner supply roller 20. Thus, with the provision of the holes 25*c*, toner is allowed to escape through the holes 25*c*, and therefore, toner is not compacted downward of the stirring portion 25*a* by the oscillatory movement of the stirring portion 25*a*. Therefore, it is ensured that toner remains fluid so that the toner supply roller 20 is efficiently supplied with toner. Here, each of the holes 25*c* in the downstream row, in terms of the rotational direction of the toner supply roller 20, will be referred to as a first hole 25*c*1, and each of the holes 25*c* in the upstream row, will be referred to as a second hole 25*c*2. The positional relationship between the first and second holes 25*c*1 and 25*c*2, in terms of roughly the width direction of the stirring portion 25*a*, is such that if the first and second holes 25*c*1 are projected upon the rotational axis of the toner supply roller 20, they partially overlap with each other. This structural arrangement significantly reduces the nonuniformity in the stirring of toner in terms of the lengthwise direction of the toner supply roller 20. Referring to FIG. 6, designated by an alphanumeric referential symbol 25*c*3 is one of the holes 25*c* which is in the same row as the row to which the second hole 25*c*2 belongs, and which is next to the hole 25*a*2. Referential letter R is the area between the second and third holes 25*c*2 and 25*c*3. If the area R and first hole 25*c*1 are projected upon the rotational axis of the toner supply roller 20, the area R partially overlaps with the first hole 25*c*1. Therefore, it is possible to prevent the formation of an image, which is nonuniform across the area corresponding to the area R. In this embodiment, the first holes 25*c*1 belong to the first portion 25*g*, whereas the second and third holes 25*c*2 and 25*c*3 belong to the second portion 25*h*. However, the process cartridge 7 may be designed so that these holes belong to the portions of the stirring portion 25*a*, which are different from the portions to which they belong in this embodiment. That is, the process cartridge 7 may be designed so that the second portion 25*h* is provided with the first holes 25*c*1, and the first portion 25*g* is provided with the second and third holes 25*c*2 and 25*c*3.

According to this embodiment, the stirring portion 25*a* is reciprocally moved so that the free edge portion of the stirring portion 25*a* enters the first area e and reciprocally moves in the first area e. Therefore, the toner in the first area e is stirred by the free edge portion 25*a*, being thereby prevented from becoming compacted. Therefore, it does not occur that toner reduces in fluidity in the area e. Also according to this embodiment, it is possible to improve a process cartridge 7 in terms of the efficiency with which toner is supplied to the second area f and toner supply roller 20. Therefore, it is possible to ensure that the toner is reliably supplied by a proper amount from the toner supply roller 20 to the development roller 17 to prevent the formation of an unsatisfactory image, that is, an image suffering from the nonuniformity attributable to unsatisfactory toner delivery to the toner supply roller 20.

As described above, according to this embodiment, the elastic toner conveying member 22 becomes separated from the internal surface of the toner storage chamber 18*a* after the toner conveying member 22 moves past the area of the toner storage chamber 18*a*, which corresponds to the guiding portion 18*a*2 of the toner storage chamber 18*a*. More specifically, as soon as the toner conveying member 22 becomes separated from the internal surface of the toner storage chamber 18*a*, the toner on the toner conveying member 22 is conveyed (catapulted) into the development chamber 18*b*, which is right above the toner storage chamber 18*a*. Further, according to this embodiment, the process cartridge 7 is structured so that toner is conveyed upward. Therefore, it is possible to realize an image forming apparatus structured so that the process cartridge 7 is mountable directly below the intermediary transfer belt 5, for example. With the placement of the process cartridge 7 directly below the intermediary transfer belt 5, it is possible to place the fixing apparatus 10 away from the scanner unit 3, developing apparatus, and/or the process cartridge 7, as described above, making it thereby possible to prevent them (scanner unit 3, developing apparatus 4 and/or process cartridge 7) from being affected by the heat from the fixing apparatus 10, or to eliminate or reduce the space necessary for reducing the effects of the heat from the fixing apparatus 10 upon the scanner unit 3, developing apparatus 4, and/or process cartridge 7. Therefore, it is possible to reduce in size an image forming apparatus (100); it is possible to reduce an image forming apparatus (100) in height, for example.

According to this embodiment, the toner conveying member 22 is elastic. Therefore, it is catapulted by the force generated by the resiliency (elasticity) of the toner conveying member 22. Thus, the employment of the toner conveying member 22 in this embodiment makes it possible to reduce in size the toner storage chamber 18*a*, compared to the toner storage chamber (18*a*) of a process cartridge employing a stirring member or the like structured so that toner is conveyed to the development chamber 18*b* while remaining held by the stirring member or the like. Moreover, practically, only the elastic toner conveying member is required to convey toner. Therefore, it is possible to realize a toner conveying mechanism which is small in component count, simple in structure, and inexpensive.

Thus, even if an image forming apparatus (process cassette) needs to be structured to convey toner against gravity, it is possible to provide an image forming apparatus which is simple in structure, low in cost, and small in size, and yet, does not form an unsatisfactory image, more specifically, an image suffering from unwanted white spots or the like attributable to unsatisfactory toner delivery.

Further, the stirring portion 25*a*, which is oscillatory, is disposed between the toner supply roller 20 in the development chamber 18*b*, and the partition wall 26 which separates the development chamber 18*b* from the toner storage chamber 18*a*. Therefore, after toner is supplied to the development chamber 18*b*, it is ensured that the toner is stirred so that it is efficiently supplied to the toner supply roller 20. Therefore, it is ensured that toner is reliably supplied by a proper amount from the toner supply roller 20 to the development roller 17. Therefore, it is possible to prevent the formation of an unsatisfactory image, more specifically, an image suffering from the nonuniformity attributable to the unsatisfactory toner delivery.

Embodiment 2

Next, another (second) preferred embodiment of the present invention will be described. The developing apparatus, process cartridge, and image forming apparatus, in this embodiment, are the same in basic structure as those in the first preferred embodiment. Therefore, the components, or the like, of the image forming apparatus in this embodiment, which are the same in function and structure as the counterparts in the first embodiment will be given the same referential symbols as those given to the counterparts in the first embodiment, and will not be described in detail. This embodiment is different from the first embodiment in that the guiding portion 18*a*2 in this embodiment is shaped so that a portion of the guiding portion 18*a*2 protrudes inward of the toner storage chamber 18*a*, as seen from the direction perpendicular to the lengthwise direction of the process cartridge 7.

Figure 7:
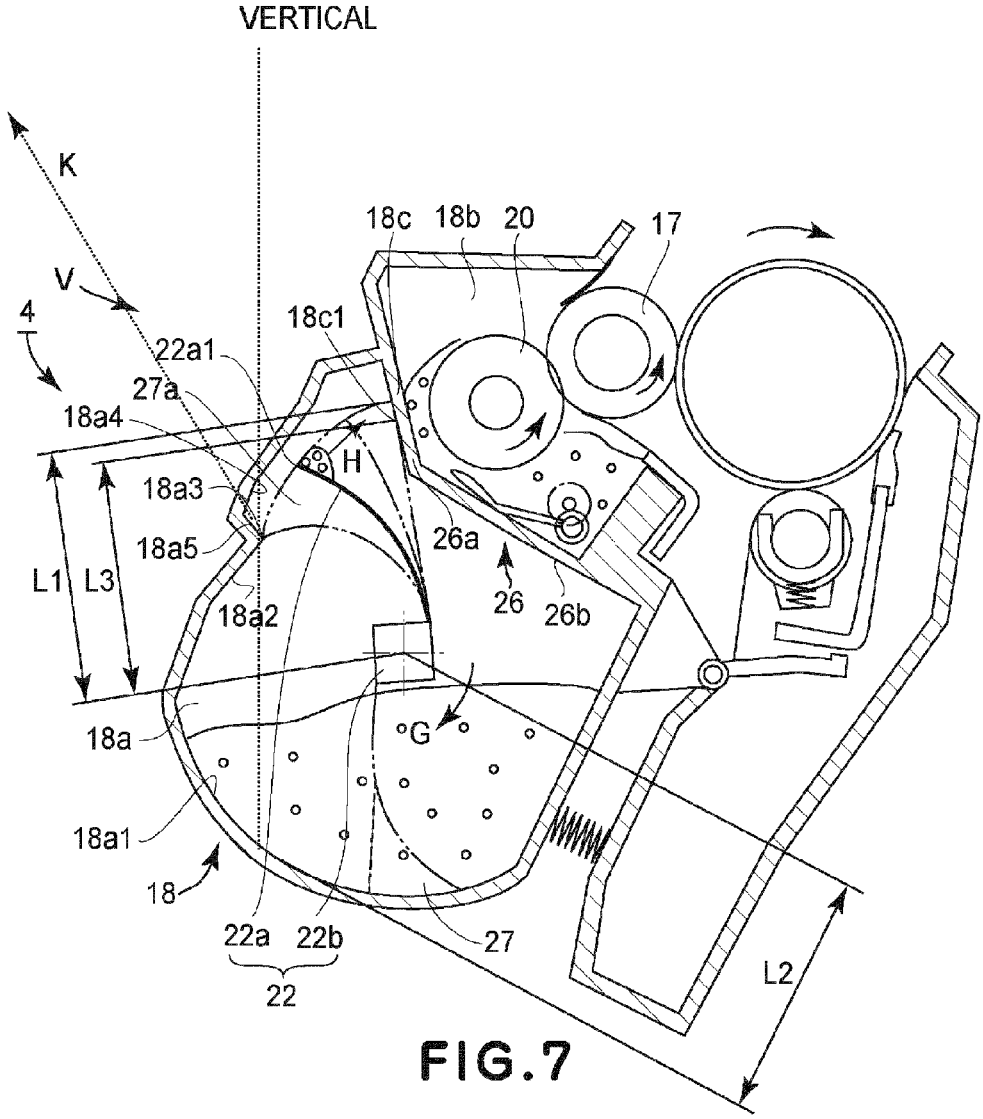
FIG. 7 is a cross-sectional view of the process cartridge in another (second) of the preferred embodiments of the present invention.

FIG. 7 is a cross-sectional view of the process cartridge 7 in this embodiment. In this embodiment, the guiding portion 18*a*2 of the toner storage chamber 18*a* is on the upstream side of the hole 18*c* of the partition wall 26, in terms of the rotation direction G of the toner conveying member 22. Here, the guiding portion 18*a*2, which is a portion of the wall of the toner storage chamber 18*a*, functions as the portion which causes the sheet portion 22*a* to deform against its own resiliency as the toner conveying member 22 rotates. The shape of the guiding portion 18*a*2 is such that as the toner conveying member 22 is rotated in the direction indicated by the arrow mark G, the distance between the guiding portion 18*a*2 and the rotational axis of the toner conveying member 22 gradually reduces. Further, the toner storage chamber 18*a* is provided with a recovery space, which corresponds to a recovery portion 18*a*4 of the wall of the toner storage chamber 18*a*, with which the sweeping edge 22*a*1 of the free edge portion of the sheet portion 22*a* does not make contact. In terms of the rotational direction G of the toner conveying member 22, the recovery portion 18*a*4 is on the downstream side of the guiding portion 18*a*2, and on the upstream side of the hole 18*c*. More specifically, the recovery portion 18*a*4 is a part of the internal surface of the wall of the toner storage chamber 18*a*. Also in terms of the rotational direction G of the toner conveying member 22, the recovery portion 18*a*4 is on the downstream side of the downstream end (which hereafter will be referred to as "border line") of the guiding portion 18*a*2. Further, the recovery portion 18*a*4 is created by forming the internal surface wall of the toner storage chamber 18*a* so that a step-like portion 18*a*5 is provided between the guiding portion 18*a*2 and recovery portion 18*a*4. Further, the recovery portion 18*a*4 is shaped so that in terms of the rotational direction G of the toner conveying member 22, the distance between the recovery portion 18*a*4 and the rotational axis of the toner conveying member 22 gradually increases. Here, the step-like portion 18*a*5 is slanted so that its angle is greater than the angle of repose of toner so that as toner comes into contact with the step-like portion 18*a*5, it slides downward. Further, when the sheet portion 22*a* of the toner conveying member 22 is in the above-mentioned recovery space, the sweeping edge 22*a*1 of the free end portion of the sheet portion 22*a* does not make contact with the internal surface of the wall of the toner storage chamber 18*a*.

After the rotation of the toner conveying member 22 causes the sweeping edge 22*a*1 of the free end portion of the sheet portion 22*a* to move past the border line 18*a*3 (border line), there is no contact between the sheet portion 22*a* and the internal surface (recovery portion 18*a*4) of the wall of the toner storage chamber 18*a*. Thus, as soon as the sweeping edge 22*a*1 moves past the border line 18*a*3, the sheet portion 22*a* is allowed to restore its natural shape. Since the sheet portion 22*a* is formed of an elastic substance (highly resilient substance), it instantly restores its natural shape, that is, the shape prior to its deformation, as soon as it is allowed to restore its natural shape. As a result, the toner on the sheet portion 22*a* (toner on toner conveying member 22) is catapulted by the force generated by the resiliency of the sheet portion 22*a* toward the hole 18*c* (direction indicated by arrow mark H in FIG. 7). Incidentally, also in this embodiment, the border line 18*a*3 is at a lower level than the bottom edge 18*c*1 of the hole 18*c*.

Figure 8:
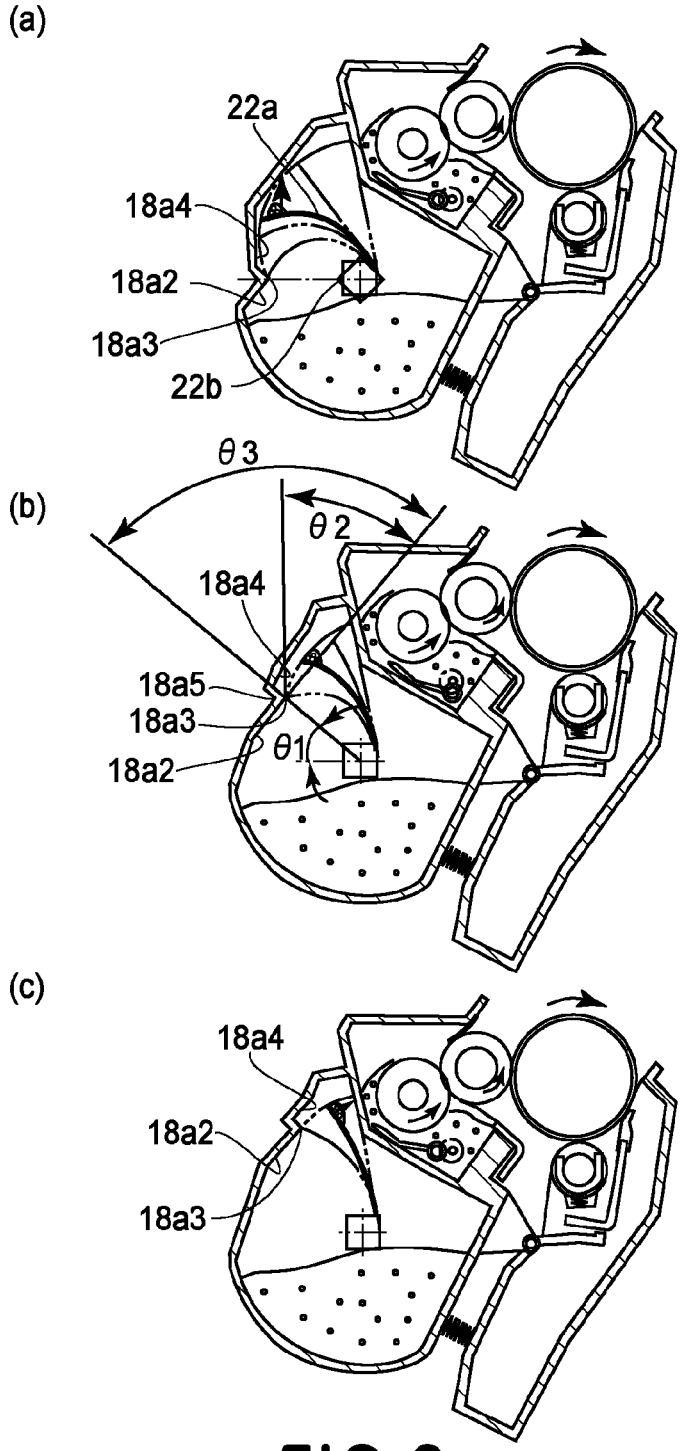
FIG. 8 is a cross-sectional view of the process cartridge in the second embodiment of the present invention, showing how toner is being conveyed in the development chamber.

Next, the toner behavior which occurs when the border line 18*a*3 coincides with the horizontal line which coincides with the rotational axis of the toner conveying member 22, and the toner behavior which occurs when the border line 18*a*3 is above the above-mentioned horizontal line, will be described. FIG. 8 is a cross-sectional view of the process cartridge 7, showing the change which the change in the position of the border line 18*a*3 causes to the manner in which toner is conveyed.

FIG. 8(*a*) corresponds to the case in which the border line 18*a*3 (point at which sweeping edge 22*a*1 of sheet portion 22*a* leaves guiding portion 18*a*2, that is, point at which sheet portion 22*a* is freed from guiding portion 18*a*2) coincides with the horizontal line which coincides with the rotational axis of the toner conveying member 22. In this case, the amount by which toner slides off the sheet portion 22*a* is small. Therefore, the amount by which toner collects on the free end portion of the sheet portion 22*a* is larger. On the other hand, the distance from the border line 18*a*3 to the hole 18*c* is greater. Thus, adjustment has to make to satisfactorily convey (catapult) toner into the development chamber 18*b*. For example, toner can be satisfactorily conveyed into the development chamber 18*b* by increasing in thickness the sheet portion 22*a* to increase the amount of force generated by the resiliency of the sheet portion 22*a* when the sheet portion 22*a* is freed from the guiding portion 18*a*2 (sheet deforming portion), provided that the sheet portion 22*a* is not changed in material. If it is preferred to change in material the sheet portion 22*a*, toner can be conveyed into the development chamber 18*b* by using a substance which is relatively high in rigidity, as the material for the sheet portion 22*a*, just as satisfactorily as by changing in thickness the sheet portion 22*a* as described above.

FIGS. 8(*b*) and 8(*c*) correspond to the cases in which the border line 18*a*3 is above the horizontal line which coincides with the rotational axis of the toner conveying member 22. In the case of the structural arrangement shown in FIG. 8(*c*), the border line 18*a*3 is farther above the horizontal line than in the case shown in FIG. 8(*b*). That is, in the case of the structural arrangements shown in FIGS. 8(*b*) and 8(*c*), the border line 18*a*3 is closer to the hole 18*c* of the partition wall 26 than in the case of the structural arrangement shown in FIG. 8(*a*). In these cases, the amount by which toner slides downward on the sheet portion 22*a* is greater, being therefore smaller in the amount by which toner collects on the free end portion of the sheet portion 22*a*, than that in the case shown in FIG. 8(*a*). In these cases, therefore, adjustment has to be made to satisfactorily convey (catapult) toner into the development chamber 18*b*. For example, toner can be satisfactorily conveyed into the development chamber 18*b* by reducing in thickness the sheet portion 22*a* to make the sheet portion 22*a* bend more so that toner collects on the free end portion of the sheet portion 22*a* by a greater amount, provided that the sheet portion 22*a* is not changed in material. If it is preferred to change the material of the sheet portion 22*a*, the amount by which toner collects on the free end portion of the sheet portion 22*a* can be increased by using a substance which is relatively low in rigidity, as the material for the sheet portion 22*a*. If a substance which is relatively low in rigidity is used as the material for the sheet portion 22*a*, the sheet portion 22*a* is smaller in resiliency. However, the distance from the border line 18*a*3 to the hole 18*c* of the partition wall 26 is shorter. Therefore, toner can be conveyed to the development chamber 18*b*, just as satisfactorily as by changing in thickness the sheet portion 22*a* as described above.

The earnest studies made in consideration of the above described subjects revealed the following. That is, in order to convey toner into the development chamber 18*b* by a satisfactory amount to prevent the problem of an unsatisfactory image, that is, an image suffering from the unwanted white spots or the like which are attributable to the unsatisfactory toner delivery, it is desired that the position of the guiding portion 18*a*2 is set as follows.

That is, the position of the border line 18*a*3 is desired to be at the same level as the horizontal plane which includes the rotational axis of the toner conveying member 22, or to be above this horizontal plane.

To elaborate, it is desired that an angle θ1, which is the angle formed by the horizontal line which coincides with the rotational axis of the toner conveying member 22 and the straight line connecting the rotational axis of the toner conveying member 22 and border line 18*a*3, is in the following range:

$$0° \leqq \theta 1 \leqq 70° \quad (4)$$

Further, it is desired that an angle θ2, which is the angle formed by the vertical straight line which coincides with the border line 18*a*3 and the surface (tangential line) of the guiding portion 18*a*2 is in the following range:

$$15° \leqq \theta 2 \leqq 60° \quad (5)$$

Further, the wall of the toner storage chamber 18*a* is shaped so that the sweeping edge 22*a*1 of the free end portion of the sheet portion 22*a* does not make contact with the internal surface of the wall of the toner storage chamber 18*a* after the sheet portion 22*a* is allowed to restore its natural shape. Further, it is desired that an angle θ3, which is the angle formed by the hypothetical extension of the surface (tangential to bent portion of sheet portion 22*a*) and the straight line which coincides with the step-like portion 18*a*5, which is between the guiding portion 18*a*2 and recovery portion 18*a*4, is within the following range:

$$0° \leqq \theta 3 \leqq 90° \quad (6)$$

Also in this embodiment, the relationship among the distances L1, L2, L3, and L4, which was described regarding the first embodiment, is applicable.

As described above, this embodiment can provide the same effects as those obtained by the first embodiment. Further, in this embodiment, the process cartridge 7 is structured so that the distance between the guiding portion 18*a*2 and the rotational axis of the toner conveying member 22 is smallest at the border line 18*a*3, and also, so that the distance between the guiding portion 18*a*2 and the rotational axis of the toner conveying member 22 gradually reduces as the toner conveying member 22 rotates in the direction indicated by the arrow mark G. That is, the closer to the border line 18*a*3, the smaller the distance between the guiding portion 18*a*2 and the rotational axis of the toner conveying member 22. Therefore, as the sheet portion 22*a* moves through the area of the toner storage chamber 18*a*, which corresponds to the guiding portion 18*a*2, the sheet portion 22*a* gradually increases in deformation. Then, as soon as the sheet portion 22 moves past the border line 18*a*3, it is allowed to instantly restore its natural shape. Therefore, this embodiment is greater in the amount by which toner is supplied to the development chamber 18*b* than the first embodiment.

Incidentally, also in this embodiment, by the time when the sweeping edge of the toner conveying member 22 separates from the border line 18*a*3, the toner conveying member 22 will have rotated into the position in which its sweeping edge portion is placed in contact with the adjacencies of the hole 18*c* by its resiliency (elasticity).

Further, also in this embodiment, the maximum value of the radius of the sweeping area of the toner conveying member 22 is greater than the distance between the rotational axis of the toner conveying member 22 and the bottom edge 18*c*1 of the hole 18*c*. Therefore, it is ensured that the toner in the toner storage chamber 18*a* is reliably supplied by a satisfactory amount to the development chamber 18*b* through the hole 18*c*.

Further, also in this embodiment, the process cartridge 7 is structured so that when the sweeping edge portion of the toner conveying member 22 is in contact with the border line 18*a*3, the normal line to the above-mentioned locus of the sweeping edge of the toner conveying member 22 at the sweeping edge, which extends downstream in terms of the rotational direction of the toner conveying member 22, is on the opposite side of the vertical line which extends upward from the sweeping edge of the toner conveying member 22, from the hole 18*c*. Therefore, the amount by which toner is held on the toner conveying member 22 immediately before the catapulting of toner is significantly greater than that in the first embodiment. Therefore, toner can be more efficiently supplied to the development chamber 18*b* through the hole 18*c*.

Embodiment 3

Next, another (third) preferred embodiment of the present invention will be described. The developing apparatus, process cartridge, and image forming apparatus, in this embodiment, are the same in basic structure as those in the first and second preferred embodiments. Therefore, the components, or the like, of the image forming apparatus in this embodiment, which are the same in function and structure as the counterparts in the first and second embodiments will be given the same referential symbols as those given to the counterparts in the first and second embodiments, and will not be described in detail. This embodiment is different from the first and second embodiments in that a toner conveying member 28 in this embodiment, which is provided in the toner storage chamber 18*a* in this embodiment, is different in structure from the toner conveying members 22 in the first and second embodiments.

Figure 9:
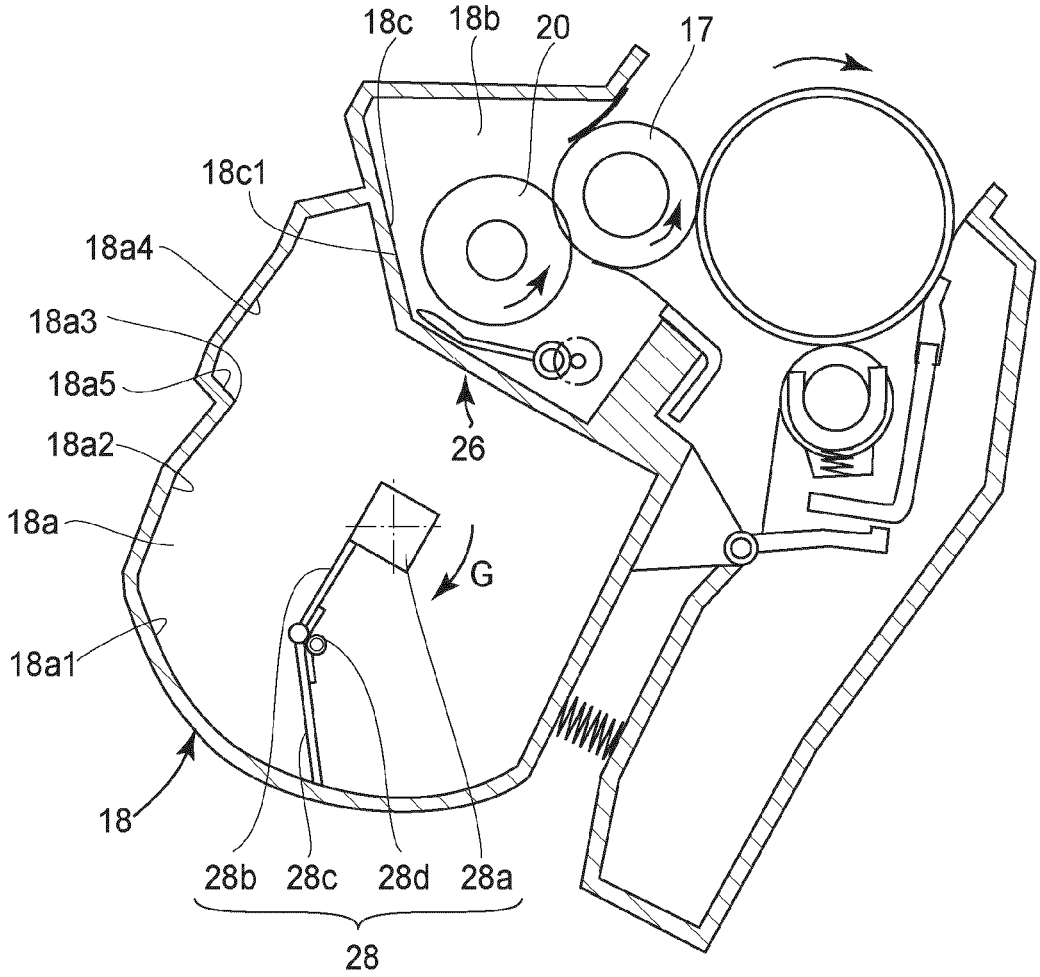
FIG. 9 is a cross-sectional view of the process cartridge in yet another (third) of the preferred embodiments of the present invention.
Figure 10:
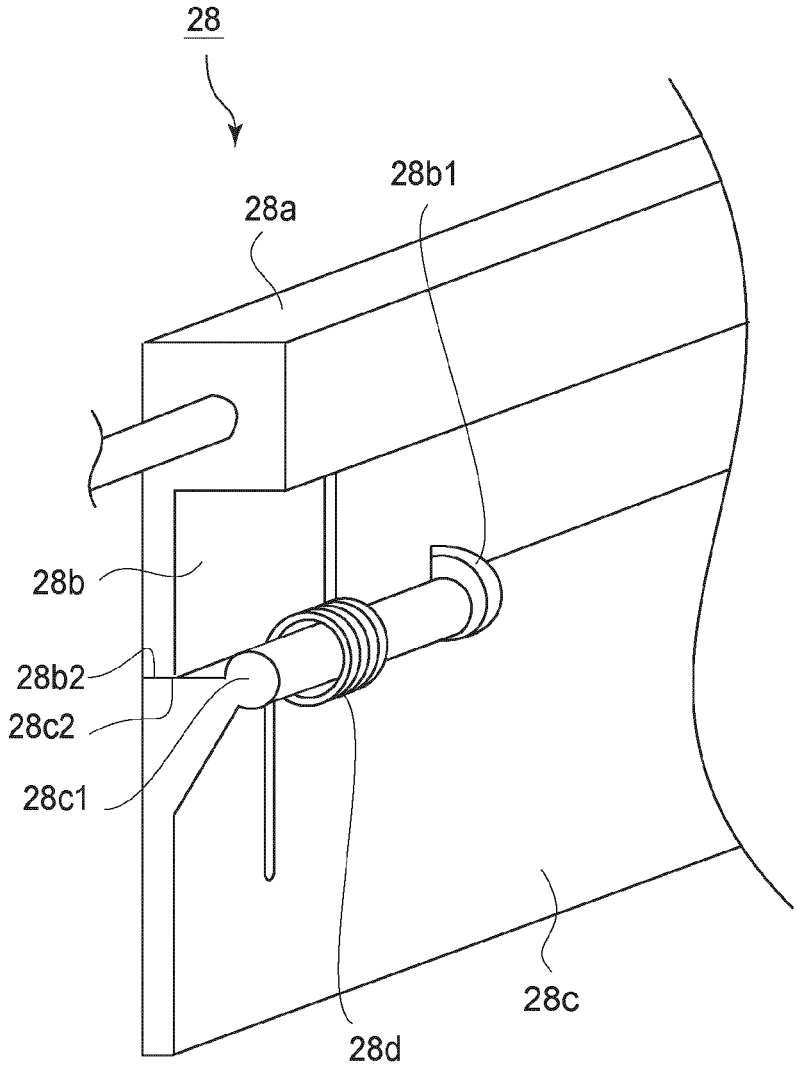
FIG. 10 is an enlarged perspective view of a part of the toner conveying member with which the process cartridge shown in FIG. 9 is provided.

FIG. 9 is a cross-sectional view of the process cartridge 7 in this embodiment. FIG. 10 is an enlarged perspective view of a part of the toner conveying member 28 in this embodiment.

In this embodiment, the toner conveying member 28 has (a) rotational shaft 28*a*, (b) stationary wing 28*b*, and (c) rotational wing 28*c*. The stationary wing 28*b* is an integral part of the rotational shaft 28*a*. The rotational wing 28*c* is rotatable relative to the stationary wing only in the opposite direction from the rotational direction G of the toner conveying member 28. In this embodiment, the toner conveying member 28 is also provided with (d) elastic member 28*d*. The elastic member 28 is fitted around the portion of the rotational wing 28*c*, which connects the stationary wing 28*b* and rotational wing 28*c*. It is wound so that the rotational wing 28*c* is kept pressured in the same direction as the rotational direction G of the toner conveying member 28. In particular, in this embodiment, the elastic member 28*d* is a torsional coil spring 28*d* (fitted around a shaft 28*c*1, which is an integral part of the rotational wing 28*c*). The shaft 28*c*1 is fitted in the hole of the connective portion 28*b*1 of the stationary wing 28*b*, being thereby rotatably supported by the stationary wing 28*b*.

As the toner conveying member 22 is rotated in the direction indicated by the arrow mark G, the rotational wing 28*c* comes into contact with the portion 18*a*1 of the internal surface of the wall of the toner storage chamber 18*a*, and is rotated in the opposite direction from the rotational direction G of the toner conveying member 28. While the rotational wing 28*c* is in contact with the portion 18*a*1 of the toner storage chamber 18*a*, it conveys toner while remaining in the position into which it has been moved by the portion 18*a*1. As the toner conveying member 28 is rotated further, the sweeping edge of the free edge portion of the rotational wing 28*c* is moved past the border line 18*a*3. As soon as the sweeping edge is moved past the border line 18*a*3, the rotatable wing 28*b* is rotated by the force generated by the resiliency of the tortional coil spring 28*d* in the same direction as the rotational direction G of the toner conveying member 28. As a result, the rotation stopper surface 28*b*2 of the stationary wing 28*b*, which is the surface of the stationary wing 28*b* on the rotatable wing side, comes into contact with the rotation stopper surface 28*c*2, which is the surface of the rotational wing 28*c* on the stationary wing side. That is, in this embodiment, the toner conveying member 28 has the first and the second portions 28*b* and 28*c*. The second portion 28*c* is rotatably connected to the first portion 28*b*. It is located farther from the rotational axis of the toner conveying member 28 than the first portion 28*b*. Also in this embodiment, the toner conveying member 28 is provided with the elastic member 28*d*, which keeps the second portion 28*c* pressured so that the second portion 28*c* rotates in the same direction as the rotational direction of the toner conveying member 28. Further, as the toner conveying member 28 is rotated, it changes in shape. More specifically, as the toner conveying member 28 is rotated, its second portion 28*c* is rotated by the guiding portion 18*a*2 against the force generated by the resiliency of the elastic member 28*d*.

As described above, as the rotational wing 28*c* rotates in the same direction as the rotational direction G of the toner conveying member 28, the toner which is being conveyed by the rotational wing 28*c*, is catapulted by the rotational wing 28*c*. In other words, the toner conveying member 28 in this embodiment plays the same role as those of the toner conveying members 22 in the first and second embodiments.

The relationship among the distances L1, L2, L3, and L4, which was described regarding the first embodiment, also applies to this embodiment. Incidentally, in this embodiment, the distance L1 is equivalent to the radius (maximum value) of the sweeping area of the toner conveying member 28 when the rotational stopper surface 28*b*2 of the stationary wing 28*b* is in contact with the rotation stopper surface 28*c*2 of the rotational wing 28*c*. Further, also in this embodiment, the same ranges as those described regarding the second embodiment is applicable to the angles θ1, θ2, and θ3 in this embodiment.

In particular, in this embodiment, the radius of the sweeping area of the toner conveying member 28 when the rotation stopper surfaces 28*b*2 and 28*c*2 are in contact with each other is desired to be greater than the distance from the rotational axis of the toner conveying member 28 to the bottom edge 18*c*1 of the hole 18*c*, as the radius of the sweeping area of the toner conveying member 22 is desired to be greater than the distance from the rotational axis of the toner conveying member 22 to the bottom edge 18*c*1 of the hole 18*c*, in the first embodiment. Further, also in this embodiment, it is desired, as in the second embodiment, that the position of the guiding portion 18*a*2 is set so that the angle θ1 is in the range expressed by the formula: $0° \leqq \theta 1 \leqq 70°$.

As described above, this embodiment can provide the same effects as those provided by the first and second embodiments. However, in this embodiment, the force for upwardly conveying toner is generated by the resiliency of the torsional coil spring 28*d*, and therefore, toner can be more reliably supplied by a satisfactory amount into the development chamber 18*b* regardless of the amount of toner in the toner storage chamber 18*a*.

Embodiment 4

Next, another (fourth) preferred embodiment of the present invention will be described. The developing apparatus, process cartridge, and image forming apparatus, in this embodiment, are the same in basic structure as those in the first and second preferred embodiments. Therefore, the components, or the like, of the image forming apparatus in this embodiment, which are the same in function and structure as the counterparts in the first and second embodiments will be given the same referential symbols as those given to the counterparts in the first and second embodiments, and will not be described in detail. This embodiment is different, in the position of the hole 18*c* relative to the toner supply roller 20, from the first and second embodiments.

Figure 11:
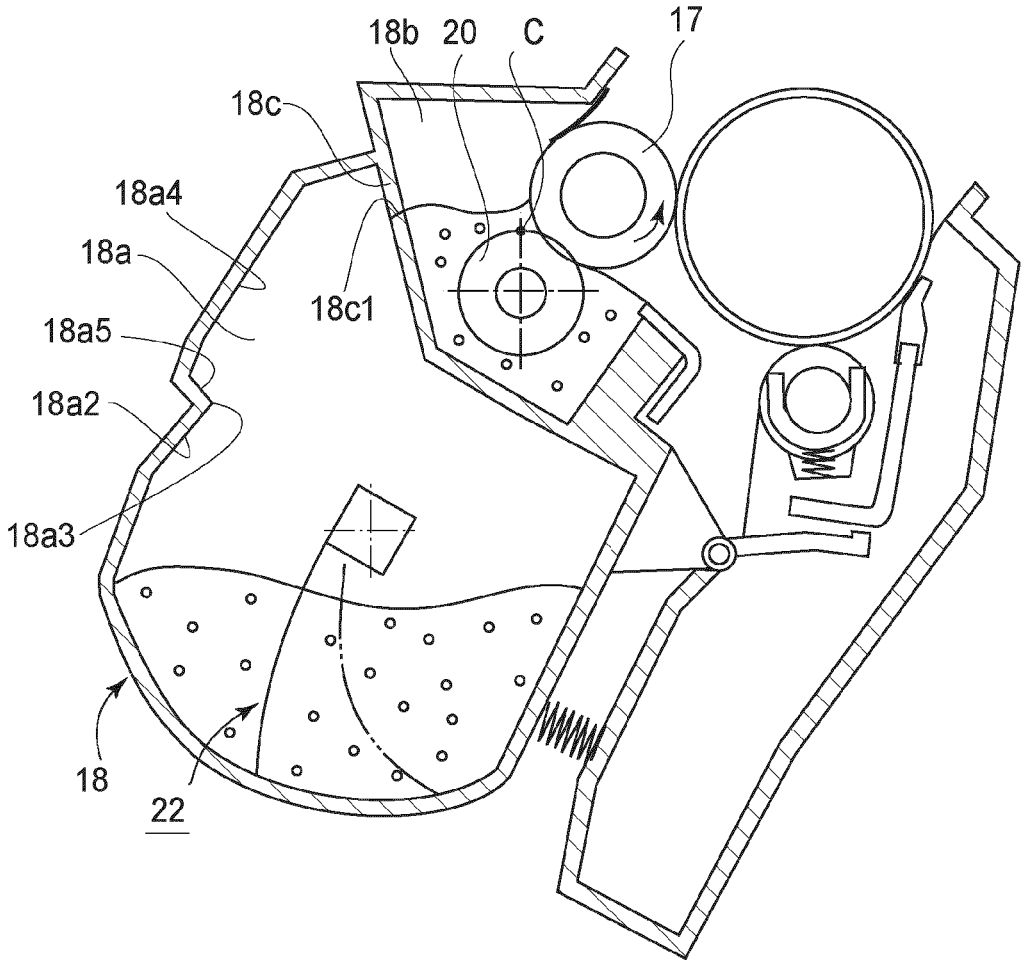
FIG. 11 is a cross-sectional view of the process cartridge in yet another (fourth) of the preferred embodiments of the present invention.

FIG. 11 is a cross-sectional view of the process cartridge 7 in this embodiment. In this embodiment, the bottom edge of the hole 18*c* with which the partition wall 26 between the toner storage chamber 18*a* and development chamber 18*b* is provided, is above the horizontal plane which includes the top c (highest point) of the toner supply roller 20.

Incidentally, for the purpose of simplifying the description of this embodiment, the stirring member 25 in the development chamber 18*b*, which was described regarding the first embodiment, is not shown in FIG. 11. However, also in this embodiment, a stirring member similar to the stirring members 25 in the first and second embodiments may be provided in the development chamber 18*b*.

In particular, also in this embodiment, it is desired, as in the second embodiment, that the position of the guiding portion 18*a*2 is set so that the angle θ1 is in the range expressed by the formula: $0° \leqq \theta 1 \leqq 70°$.

In this embodiment, the direction in which toner is catapulted can be adjusted by adjusting the position of the guiding portion 18*a*2 and/or the thickness of the sheet portion 22*a*. Therefore, even if the process cartridge 7 is structured so that the hole 18*c* is above the horizontal plane which includes the highest point c of the toner supply roller 20, the following adjustment can be made to satisfactorily convey toner into the development chamber 18*b*. That is, in this case, all that is necessary is to adjust the amount by which toner is conveyed is to make such an adjustment as positioning the guiding portion 18*a*2 above the horizontal plane which coincides with the rotational axis of the toner conveying member 22, and increasing in thickness the sheet portion 22*a*.

As described above, this embodiment also can provide the same effects as those provided by the first and second embodiments. In this embodiment, however, the entirety of the peripheral surface of the toner supply roller 20 is covered with the toner conveyed into the development chamber 18*b* by the toner conveying member 22. Therefore, toner is more easily supplied from the toner supply roller 20 to the development roller 17 than in the first and second embodiments.

Embodiment 5

Next, another (fifth) preferred embodiment of the present invention will be described. The developing apparatus, process cartridge, and image forming apparatus, in this embodiment, are the same in basic structure as those in the first and second preferred embodiments. Therefore, the components, or the like, of the image forming apparatus in this embodiment, which are the same in function and structure as the counterparts in the first and second embodiments will be given the same referential symbols as those given to the counterparts in the first and second embodiments, and will not be described in detail. This embodiment is different from the first and second embodiments, in the structure of the partition wall 26 which separates the development chamber 18*b* from the toner storage chamber 18*a*.

Figure 12:
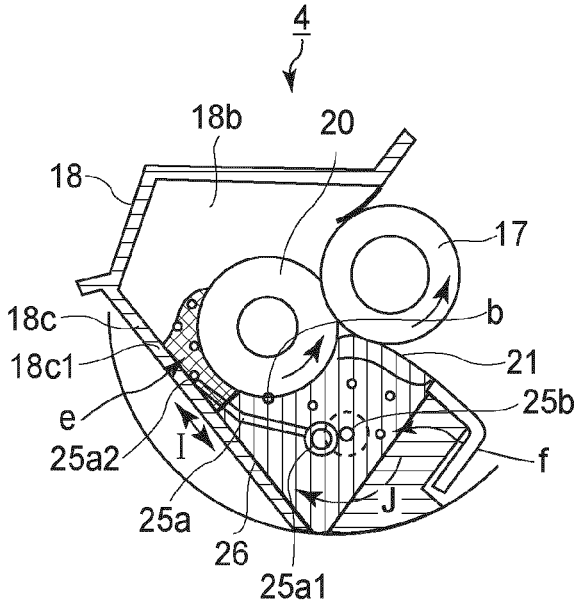
FIG. 12 is a cross-sectional view of a part of the process cartridge in the fifth of the preferred embodiments of the present invention.

FIG. 12 is a cross-sectional view of a part of the process cartridge 7 in this embodiment. In this embodiment, the process cartridge 7 is structured so that the partition wall 26, which separates the development chamber 18*b* from the toner storage chamber 18*a*, is a single flat piece of wall and angled relative to the horizontal plane.

The partition wall 26 in this embodiment is also provided with the hole 18*c* through which toner is conveyed from the toner storage chamber 18*a* into the development chamber 18*b*, as are the partition walls 26 in the first and second embodiments. The bottom edge 18*c*1 of the hole 18*c* is above the horizontal plane which coincides with the lowest point b of the toner supply roller 20. Further, in the second area f of the development chamber 18*b*, which is surrounded by the toner supply roller 20, partition wall 26, and development blade 21, the stirring member 25 is located. To describe in more detail, the second area f is the area surrounded by the toner supply roller 20, the portion of the partition wall 26, which is below the toner supply roller 20, and development blade 21.

Regarding the locus of the free edge portion 25*a*2 of the stirring portion 25*a*, the stirring member 25 is positioned so that as the stirring portion 25*a* is reciprocally moved, the free edge portion 25*a*2 of the stirring portion 25*a* enters the first area e of the development chamber 18*b* and contacts the toner therein. The first area e is the area between the toner supply roller 20, and the portion of the partition wall 26, which is below the horizontal plane which coincides with the bottom edge of the hole 18*c* and on the lateral side (left side in drawings) of the toner supply roller 20. Therefore, it is possible to prevent the problem that as toner is supplied to the development chamber 18*b*, it reduces in fluidity by becoming compacted in the first area e and its adjacencies. Therefore, toner can be more efficiently supplied to the second area f and the toner supply roller 20.

Embodiment 6

Next, another (sixth) preferred embodiment of the present invention will be described.

The developing apparatus, process cartridge, and image forming apparatus, in this embodiment, are the same in basic structure as those in the first and second preferred embodiments. Therefore, the components, or the like, of the image forming apparatus in this embodiment, which are the same in function and structure as the counterparts in the first and second embodiments will be given the same referential symbols as those given to the counterparts in the first and second embodiments, and will not be described in detail. This embodiment is different from the first and second embodiments, in the structure of the partition wall 26 which separates the development chamber 18*b* from the toner storage chamber 18*a*.

Figure 13:
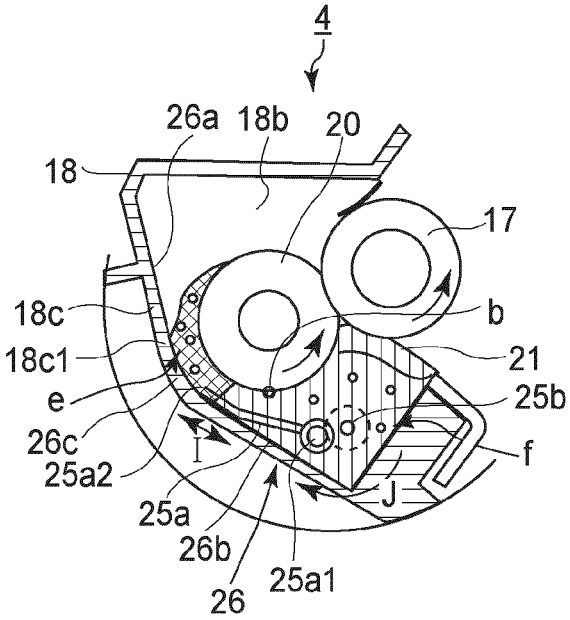
FIG. 13 is a cross-sectional view of a part of the process cartridge in yet another (sixth) of the preferred embodiments of the present invention.

FIG. 13 is a cross-sectional view of a part of the process cartridge 7 in this embodiment. In this embodiment, the partition wall 26 which separates the development chamber 18*b* from the toner storage chamber 18*a* has a curved portion 26*c*, the curvature of which is such that the distance between the curved portion 26*c* and the peripheral surface of the toner supply roller 20 is uniform. That is, in this embodiment, a part of the partition wall 26 is curved in a manner to conform to the curvature of the peripheral surface of the toner supply roller 20. In other words, in this embodiment, the portion of the partition wall 26, which corresponds to the angled connective portion between the first and second portions 26*a* and 26*b* of the partition wall 26 in the first embodiment, is curved.

The hole 18*c* for conveying toner from the toner storage chamber 18*a* to the development chamber 18*b* is positioned higher than the curved portion 26*c* of the partition wall 26. Further, the bottom edge 18*c*1 of the hole 18*c* is positioned higher than the lowest point b of the toner supply roller 20. Further, in the second area f of the development chamber 18*b*, which is surrounded by the toner supply roller 20, partition wall 26, and development blade 21, the stirring member 25 is located. To describe in more detail, the second area f is the area surrounded by the toner supply roller 20, the portion of the partition wall 26, which is below the toner supply roller 20, and the blade 21.

Regarding the locus of the sweeping edge 25*a*2 of the stirring portion 25*a*, the stirring member 25 is disposed so that as the stirring portion 25*a* is reciprocally moved, the sweeping edge 25*a*2 enters the first area e of the development chamber 18*b*, and contacts the toner therein. The first area e is the area between the toner supply roller 20, and the curved portion 26*c* of the partition wall 26, which is below the horizontal plane which coincides with the bottom edge of the hole 18*c*. Therefore, it is possible to prevent the problem that as toner is supplied to the development chamber 18*b*, it reduces in fluidity by becoming compacted in the first area e and its adjacencies. Therefore, toner can be more efficiently supplied to the second area f and the toner supply roller 20.

As described above, the structural arrangement for the process cartridge 7 in this embodiment can also make it possible to stir the toner in the development chamber 18*b* as effectively as those described regarding the first and second embodiments.

Embodiment 7

Next, another (seventh) preferred embodiment of the present invention will be described. The developing apparatus, process cartridge, and image forming apparatus, in this embodiment, are the same in basic structure as those in the first and second preferred embodiments. Therefore, the components, or the like, of the image forming apparatus in this embodiment, which are the same in function and structure as the counterparts in the first and second embodiments will be given the same referential symbols as those given to the counterparts in the first and second embodiments, and will not be described in detail. This embodiment is different from the first and second embodiments, in the structure of the stirring member 25 in the development chamber 18*b*.

Figure 14:
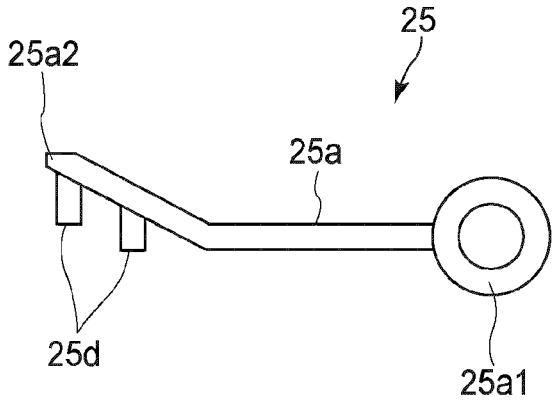
FIG. 14 is a side view of the stirring portion of the process cartridge in the seventh of the preferred embodiments of the present invention.

FIG. 14 is a side view of the stirring member 25 in this embodiment. In this embodiment, the stirring portion 25*a* is provided with multiple ribs 25*d* (projections), which project from the surface (downwardly facing surface) of the stirring portion 25*a* which is in the bottom portion of the development chamber 18*b*. That is, in this embodiment, the downwardly facing surface of the stirring portion 25*a* is provided with multiple ribs 25*d*. More specifically, in order to ensure that the toner in development chamber 18*b* is stirred across the entirety of the development chamber 18*bc* in terms of the lengthwise direction of the development chamber 18*bc*, the downwardly facing surface of the stirring portion 25*a* is provided with multiple ribs 25*d* which extend across the entirety of the development chamber 18*bc* in terms of the lengthwise direction of the development chamber 18*bc*, or multiple shorter ribs 25*d* which extend also in the lengthwise direction of the stirring portion 25*a* and are arranged in multiple rows, which are parallel to the lengthwise direction of the stirring portion 25*a* (parallel to axial line of crankshaft 25*b*), so that they overlap in terms of the width direction of the stirring portion 25*a*.

Therefore, even if toner becomes compacted on the downwardly facing surface side of the stirring portion 25*a*, in the second area f, for example, of the development chamber 18*b*, the reciprocal movement of the stirring portion 25*a* can cause the ribs 25*d* to satisfactorily loosen the compacted toner.

As described above, the structural arrangement for the process cartridge 7 in this embodiment can also make it possible to stir the toner in the development chamber 18*b* as effectively as those described regarding the first and second embodiments. In particular, in this embodiment, the provision of the ribs 25*d* on the downwardly facing surface of the stirring portion 25*a* makes it possible to more satisfactorily loosen the toner in the development chamber 18*b*. Therefore, this embodiment can better prevent the problem that toner reduces in fluidity by becoming compacted, and therefore, can more efficiently supply toner to the toner supply roller 20. Therefore, this embodiment can more effectively stabilize the amount by which toner is supplied from the toner supply roller 20 to the development roller 17, and therefore, can more effectively prevent the formation of an unsatisfactory image, more specifically, an image suffering from the nonuniformity attributable to the unsatisfactory toner delivery.

Embodiment 8

Next, another (eighth) preferred embodiment of the present invention will be described. The developing apparatus, process cartridge, and image forming apparatus, in this embodiment, are the same in basic structure as those in the first and second preferred embodiments. Therefore, the components, or the like, of the image forming apparatus in this embodiment, which are the same in function and structure as the counterparts in the first and second embodiments will be given the same referential symbols as those given to the counterparts in the first and second embodiments, and will not be described in detail. This embodiment is different from the first and second embodiments, in the structure of the stirring member 25 in the development chamber 18*b*.

Figure 15:
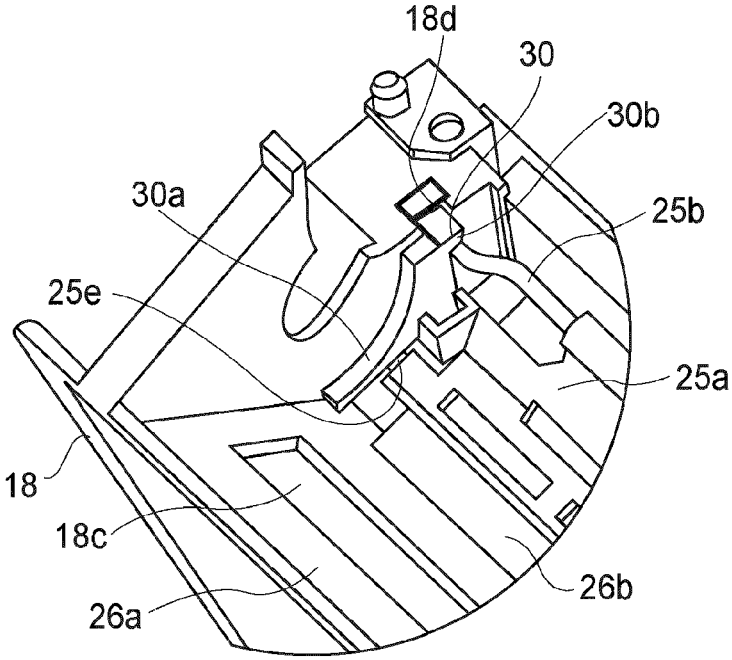
FIG. 15 is an exploded perspective view of the stirring regulating portion of the process cartridge in the eighth of the preferred embodiments of the present invention.
Figure 16:
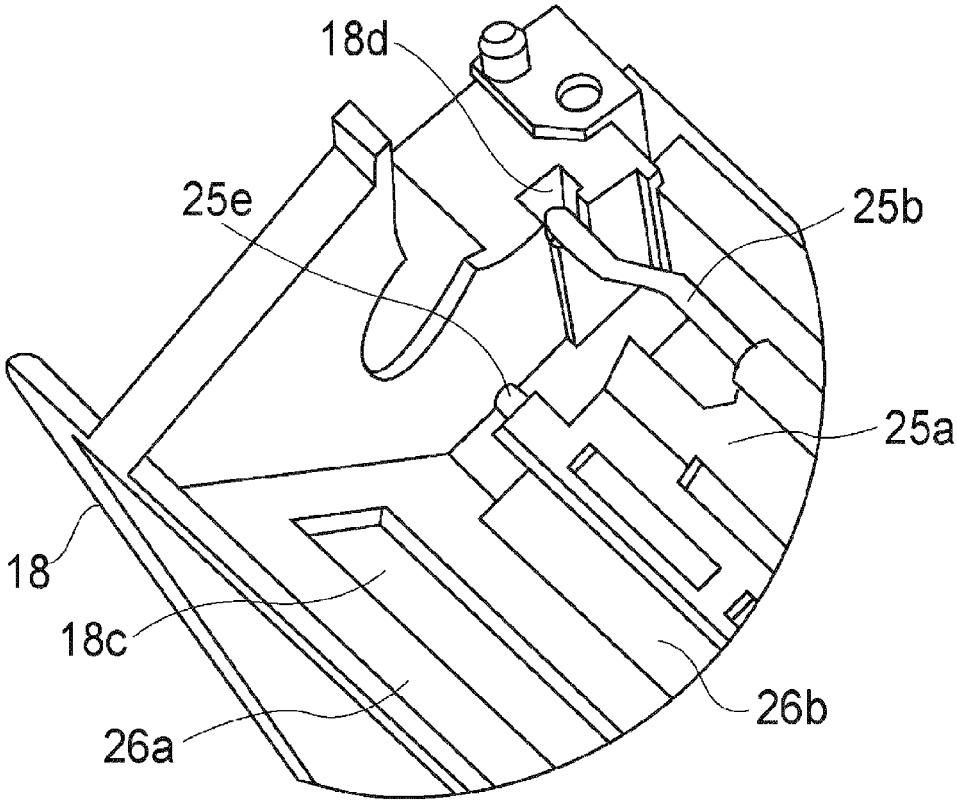
FIG. 16 is an exploded perspective view of a part of the process cartridge shown in FIG. 15, from which the stirring regulating portion has been removed.

FIGS. 15 and 16 are exploded perspective views of a part of the process cartridge 7 in this embodiment, and show the structural arrangement, in this embodiment, for controlling the vertical movement of the stirring portion 25*a*.

The stirring portion 25*a* is connected to the crankshaft 25*b*, the end portions of which are in the grooves 18*d* of the developing means frame 18. Thus, the crankshaft 25*b* is supported at its lengthwise end portions, by the developing means frame 18. A crankshaft bushing 30 is used as the member for keeping the crankshaft 25*b* pressed downward. That is, the crankshaft 25*b* is attached to the developing means frame 18 by moving each of the lengthwise end portions of the crankshaft 25*b* into the bottom of the corresponding groove 18*d* from the top side (in drawing) of the groove 18*d*. The shaft pressing portion 30*b* of the crankshaft bushing 30 prevents the lengthwise end portion of the crankshaft 25*b* from moving toward the top side of the groove 18*d*.

The crankshaft bushing 30 is provided with a portion 30*a* for regulating the stirring portion 25*a*. The stirring member regulating portion 30*a* regulates the vertical movement of the portion 25*e* (portion to be regulated) of the stirring portion 25*a*. In this embodiment, the portion 25*e* projects from the lengthwise end of the stirring portion 25*a* (which is a plate-like member), in the lengthwise direction of the stirring portion 25*a*. That is, in this embodiment, the process cartridge 7 is structured so that the crankshaft bushing 30 is utilized as the means (member) for regulating the stirring portion 25*a* in terms of its locus, in order to prevent the stirring portion 25*a* from moving upward.

Therefore, even if toner becomes compacted on the downwardly facing surface side of the stirring portion 25*a*, the stirring portion 25*a* is not lifted by the body of compacted toner, being therefore prevented from reciprocally sliding on top of the body of compacted toner. Therefore, it is ensured that the stirring portion 25*a* enters the body of compacted toner.

As described above, the structural arrangement for the process cartridge 7 in this embodiment can also make it possible to stir the toner in the development chamber 18*b* as effectively as those described regarding the first and second embodiments. In particular, in this embodiment, the stirring portion regulating portion 30*a* for regulating the vertical movement of the stirring portion 25*a* is provided. Therefore, it is further ensured that the toner in the development chamber 18*b* is effectively stirred to prevent the problem that toner reduces in fluidity by becoming compacted. Therefore, this embodiment can more satisfactorily supply the toner supply roller 20 with toner to ensure that the toner is continuously supplied a satisfactory amount from the toner supply roller 20 to the development roller 17. Therefore, this embodiment can make it possible to more effectively prevent the formation of an unsatisfactory image, more specifically, an image suffering from the nonuniformity attributable to the unsatisfactory toner delivery.

In the above, the present invention was described with reference to the concrete embodiments of the present invention. However, these embodiments are not intended to limit the present invention in applicability. That is, the preceding embodiments were described with reference to the developing apparatus (development unit), which is a part of the process cartridge removably mountable in the main assembly of an image forming apparatus. However, the application of the present invention is not limited to a developing apparatus such as those in the preceding embodiments. That is, the present invention is also applicable to a developing apparatus, which is an nonremovable part of an image forming apparatus, or a development cartridge, that is, a cartridge in which only a developing apparatus is disposed, which is removably mountable in the main assembly of an image forming apparatus.

Also, the preceding embodiments were described with reference to the image forming apparatus of the intermediary transfer type, that is, an image forming apparatus employing an intermediary transfer member. However, the preceding embodiments were not intended to limit the present invention in applicability. As has been known to the people who work in the field of image formation, there are image forming apparatuses which employ an endless conveyer belt as a member for holding and conveying recording medium. In the case of these image forming apparatuses, after the formation of a toner image on a photosensitive member, the toner image is directly transferred onto a sheet of recording medium borne by the recording medium holding member. In some image forming apparatuses of the above-mentioned direct transfer type, which employ a conveyer belt instead of an intermediary transfer belt, such as those in the preceding embodiments, image forming portions in which a process cartridge is removably mountable are disposed under the conveyer belt. In some of these image forming apparatuses, it is necessary to convey toner against gravity in the developing apparatus. In the case of these image forming apparatuses, the present invention is very effectively applicable.

According to the embodiments of the present invention described above, it is possible to provide a developer conveying mechanism which is small, simple in structure, and yet, capable of satisfactorily conveying developer against gravity. Further, it is possible to stir developer, in the area between the developer supply roller, and the partition wall located below the developer supply roller, and then, supply the stirred developer to the developer supply roller.

Incidentally, it is optional to combine two or more of the preceding embodiments described above, and the combination can provide the same effects as those obtainable by the preceding embodiments.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 333897/2006 and 278173/2007 filed Dec. 11, 2006 and Oct. 25, 2007, respectively which are hereby incorporated by reference.

What is claimed is:

1. A developer container for an image forming apparatus, comprising:

a developer accommodating chamber, provided with an opening, for accommodating a developer to be supplied to said opening;

a feeding member, provided in said developer accommodating chamber, for feeding the developer by rotation thereof, said feeding member having a free end and an elasticity;

a deformation portion provided in said developer accommodating chamber in contact with said feeding member at a position upstream of said opening with respect to a rotational direction of said feeding member, said deformation portion being capable of deforming said feeding member against the elasticity with rotation of said feeding member; and a restoration portion provided at a position downstream of said deformation portion and upstream of said opening with respect to the rotational direction of said feeding member, said restoration portion being capable of permitting said feeding member deformed by said deformation portion to be elastically restored by separating said feeding member from an internal surface of said developer accommodating chamber, and to cause the developer to jump toward said opening from said feeding member, wherein rotation of said feeding member is advanced such that when said free end of said feeding member departs a boundary portion between said deformation portion and said restoration portion, said feeding member is at such a rotational position as to be contactable to a portion of said developer accommodating chamber adjacent to said opening by the elastic restoration.

2. A developer container according to claim 1, wherein the portion of said developer accommodating chamber to which said feeding member is contactable is below said opening.

3. A developer container according to claim 1, wherein said feeding member moves the developer from an upstream side of said opening to a downstream side of said opening with respect to a rotational direction of said feeding member.

4. A developer container according to claim 1, wherein the boundary portion is disposed below a lower end of said opening.

5. A developer container according to claim 1, wherein the boundary portion is a step-like portion between said deformation portion and said restoration portion.

6. A developer container according to claim 1, wherein the boundary portion is disposed at the same level as or at a level higher than a horizontal plane passing through a rotational axis of said feeding member.

7. A developer container according to claim 1, wherein a maximum value of a rotation radius of said feeding member is larger than a distance between a rotational axis of said feeding member and the lower end of the opening.

8. A developer container according to claim 1, wherein said deformation portion is closest to a rotational axis of said feeding member at the boundary portion.

9. A developer container according to claim 1, wherein a normal line of a surface of said feeding member adjacent to the free end thereof, extending downwardly with respect to the rotational direction of said feeding member, is inclined relative to a vertical plane extending upwardly at the free end away from the opening in a state in which the free end is at the boundary portion.

10. A developing device for use with an image forming apparatus, comprising:

a developing roller for carrying a developer;

a developer chamber provided with said developing roller;

a developer accommodating chamber for accommodating the developer, said developer accommodating chamber being provided at an upper part with an opening for supplying the developer into said developer chamber;

a feeding member, provided in said developer accommodating chamber, for feeding the developer by rotation thereof, said feeding member having a free end and an elasticity;

a deformation portion provided in said developer accommodating chamber in contact with said feeding member at a position upstream of the opening with respect to a rotational direction of said feeding member, said deformation portion being capable of deforming said feeding member against the elasticity with rotation of said feeding member; and a restoration portion provided at a position downstream of said deformation portion and upstream of the opening with respect to the rotational direction of said feeding member, said restoration portion being capable of permitting said feeding member deformed by said deformation portion to be elastically restored by separating said feeding member from an internal surface of said developer accommodating chamber, and to cause the developer to jump toward the opening from said feeding member, wherein rotation of said feeding member is advanced such that when said free end of said feeding member departs a boundary portion between said deformation portion and said restoration portion, said feeding member is at such a rotational position as to be contactable to a portion of said developer accommodating chamber adjacent to said opening by the elastic restoration.

11. A developing device according to claim 10, wherein the portion of said developer accommodating chamber to which said feeding member is contactable is below said opening.

12. A developing device according to claim 10, wherein said feeding member moves the developer from an upstream side of said opening to a downstream side of said opening with respect to a rotational direction of said feeding member.

13. A developing device according to claim 10, wherein the boundary portion is disposed below a lower end of said opening.

14. A developing device according to claim 10, wherein the boundary portion is a step-like portion between said deformation portion and said restoration portion.

15. A developing device according to claim 10, wherein the boundary portion is disposed at the same level as or at a level higher than a horizontal plane passing through a rotational axis of said feeding member.

16. A developing device according to claim 10, wherein a maximum value of a rotation radius of said feeding member is larger than a distance between a rotational axis of said feeding member and the lower end of the opening.

17. A developing device according to claim 10, wherein said deformation portion is closest to a rotational axis of said feeding member at the boundary portion.

18. A developing device according to claim 10, wherein a normal line of a surface of said feeding member adjacent to the free end thereof, extending downwardly with respect to the rotational direction of said feeding member, is inclined relative to a vertical plane extending upwardly at the free end away from the opening in a state in which the free end is at the boundary portion.

19. A developing device according to claim 10, wherein when viewed in a direction of an axis of said developing roller, a rotational center of said developing roller and a rotational center of said feeding member are on the same side with respect to the vertical line passing through a boundary portion between said deformation portion and said restoration portion.

20. A process cartridge detachably mountable to an image forming apparatus, comprising:

an electrophotographic photosensitive member;

a developing roller for carrying a developer to develop an electrostatic image formed on said electrophotographic photosensitive member;

a developer chamber provided with said developing roller;

a developer accommodating chamber for accommodating the developer, said developer accommodating chamber being provided at an upper part with an opening for supplying the developer into said developer chamber;

a feeding member, provided in said developer accommodating chamber, for feeding the developer by rotation thereof, said feeding member having a free end and an elasticity;

a deformation portion provided in said developer accommodating chamber in contact with said feeding member at a position upstream of said opening with respect to a rotational direction of said feeding member, said deformation portion being capable of deforming said feeding member against the elasticity with rotation of said feeding member; and a restoration portion provided at a position downstream of said deformation portion and upstream of said opening with respect to the rotational direction of said feeding member, said restoration portion being capable of permitting said feeding member deformed by said deformation portion to be elastically restored by separating said feeding member from an internal surface of said developer accommodating chamber, and to cause the developer to jump toward said opening from said feeding member, wherein rotation of said feeding member is advanced such that when said free end of said feeding member departs a boundary portion between said deformation portion and said restoration portion, said feeding member is at such a rotational position as to be contactable to a portion of said developer accommodating chamber adjacent to said opening by the elastic restoration.

21. A process cartridge according to claim 20, wherein the portion of said developer accommodating chamber to which said feeding member is contactable is below said opening.

22. A process cartridge according to claim 20, wherein said feeding member moves the developer from a downstream side of said opening to a upstream side of said opening with respect to a rotational direction of said feeding member.

23. A process cartridge according to claim 20, wherein the boundary portion is disposed below a lower end of said opening.

24. A process cartridge according to claim 20, wherein the boundary portion is a step-like portion between said deformation portion and said restoration portion.

25. A process cartridge according to claim 20, wherein the boundary portion is disposed at the same level as or at a level higher than a horizontal plane passing through a rotational axis of said feeding member.

26. A process cartridge according to claim 20, wherein a maximum value of rotation radius of said feeding member is larger than a distance between a rotational axis of said feeding member and the lower end of the opening.

27. A process cartridge according to claim 20, wherein said deformation portion is closest to a rotational axis of said feeding member at the boundary portion.

28. A process cartridge according to claim 20, wherein a normal line of a surface of said feeding member adjacent to the free end thereof, extending downwardly with respect to the rotational direction of said feeding member, is inclined relative to a vertical plane extending upwardly at the free end away from the opening in a state in which the free end is at the boundary portion.

29. A process cartridge according to claim 20, wherein when viewed in a direction of an axis of said developing roller, a rotational center of said developing roller and a rotational center of said feeding member are on the same side with respect to the vertical line passing through a boundary portion between said deformation portion and said restoration portion.

* * * * *